United States Patent [19]

Dietrich

[11] 4,433,521

[45] Feb. 28, 1984

[54] BUILDING COMPONENT, METHOD OF CONSTRUCTION AND WALL FORMED THEREBY

[76] Inventor: Rodney J. P. Dietrich, 51 Trailridge Cres., Pent #3, West Hill, Ontario, Canada

[21] Appl. No.: 154,927

[22] Filed: May 30, 1980

[51] Int. Cl.[3] ..... E04C 1/16; E04C 1/40; E04C 2/26

[52] U.S. Cl. ..... 52/302; 52/309.12; 52/405; 52/421; 52/426; 52/436; 52/438

[58] Field of Search ..... 52/302, 309.12, 405, 52/421, 426, 436, 438

[56] References Cited

U.S. PATENT DOCUMENTS

| | | | |
|---|---|---|---|
| 1,153,900 | 9/1915 | Fairbank | 52/436 |
| 1,420,478 | 6/1922 | Forbush | 52/426 |
| 2,106,177 | 1/1938 | Hultquist | 52/438 |
| 2,647,392 | 8/1953 | Wilson | 52/436 |
| 2,811,035 | 10/1957 | Zagray | 52/436 |
| 4,263,765 | 4/1981 | Maloney | 52/309.12 |

FOREIGN PATENT DOCUMENTS

| | | | |
|---|---|---|---|
| 521794 | 2/1956 | Canada | 52/173 |
| 2440466 | 3/1976 | Fed. Rep. of Germany | 52/405 |
| 2706714 | 8/1978 | Fed. Rep. of Germany | 52/405 |

*Primary Examiner*—John E. Murtagh

*Attorney, Agent, or Firm*—Riches, McKenzie & Herbert

[57] ABSTRACT

A method is disclosed for quickly and easily forming a load bearing, insulated wall comprising self-aligning, load bearing insulated building components. In specific embodiments, the building components define a wall having internal vertical cores which communicate with horizontal canals at the interfaces between rows of the building components. In specific embodiments, the cores and canals are filled with bonding material, for example, by the pumping of mortar therein, to define the completed wall. The individual building components are adaptable in design to increase or decrease their insulative values or strength to accommodate various construction conditions and climates.

1 Claim, 37 Drawing Figures

BUILDING COMPONENT, METHOD OF CONSTRUCTION AND WALL FORMED THEREBY

BACKGROUND OF THE INVENTION

1. Field of the Invention

The invention relates to building components of the self-aligning type used to quickly and easily form load bearing, insulated walls, and relates further to the method of constructing such a wall and the wall so constructed.

2. Description of the Prior Art

The well-known, time-honored method of constructing load bearing insulated walls (using a multitude of individual building components and added insulation) has been to form a construction block or brick wall by hand mortaring, laying and leveling each piece. The builder may apply insulation to the outside or inside of the block or block wall by various means and methods before, or after, the laying of the construction block. The laying of the block and the application of the insulation is a slow process which is beginning to outdate itself due to increases in the cost of labor and the skill of that labor in today's construction market. Also, due to the length of time that it takes to build a building using these old methods, there is a resultant increase in the cost of borrowing money for the builder if he chooses the "block plus insulation method" over newer and quicker alternate methods of construction, such as wall panels, precast, or tilt-up operations.

Further costs are also due to today's greater portion in percentage of the total job cost that labor represents when comparing this with the other costs of materials and overhead.

The old methods are labor intensive not only in the constructing of the wall but also in adding to or incorporating into the wall the insulation and other desirable surface finishes, due to its usual less than perfect inside level face.

To summarize, most of the old methods' excess costs are a result of a slow building rate, a requirement of too great a percentage of skilled labor per job, and the usually less than perfect wall surfaces which slow down the insulation and/or finish work.

To date, especially in recent years, various inventors and entrepreneurs have tried to come up with a system which would solve most of the problems above discussed in each of their individual trade areas. Many self-aligning and/or interlocking bricks or blocks have been devised with or without bonding systems for quick load-bearing walls. All have solved various problems, but most failed due to the fact that they could not be consistently manufactured, or that they were too difficult or costly to construct. The few that experienced some financial success were practical in only limited ways.

In the insulation trade inventions in quickly applied systems have gained recognition as labor and time saving. Further success of these systems has been mainly due to the reduction of the so-called "thermal bridge" through the wall, i.e., improvement in the wall's thermal insulation benefits.

More recently, instead of concentrating on increasing the cost efficiency and effectiveness of the block layer's and the insulation applicator's respective trades, "specialized manufacturing" has been introduced in an effort to link these two building trades together as one.

This effort has been carried out by adding insulation into the block cores before, during or after the wall is laid. These two trades then become incorporated as one when such blocks are sold directly to the block layer, thereby eliminating the insulation installation cost. All of the new systems in this effort have fallen short in at least one or more critical areas in solving the problems herein discussed. These areas are (1) effective load bearing, (2) effective insulation and (3) quick effective construction, where all must prove to be cost effective on a final per square foot analysis. Even with the wall panel systems preconstructed at the plant with insulation, brick and mortar sandwiched together as a panel, there is still a necesity to supply a crane, specialized transport, skilled men and the necessity in most cases to consider height and load limitations. With such wall panel systems the specialization and planning is more critical, raising overhead and resultant per square foot cost. Good savings can be realized, but in specialized markets only. The general construction market has still not been provided with an overall solution giving rise to cost savings in the broad view of the market. The dwindling of the bricklayer's trade and the boom of alternate systems such as aluminum siding bears witness to this.

Though all the new systems have success and advantages in specialized areas of construction, they still need to, for the most part, eliminate the major skill and/or equipment requirement in either producing the materials and/or constructing a quickly formed, load bearing insulated wall, to effect new cost savings to stimulate new construction.

It has been proposed to assemble self aligning, insulated building components into wall formations without the necessity of applying a bonding material by hand. Thus, by pumping a bonding material, such as mortar, via a mortar nozzle tube lowered into inner vertically aligned openings formed by each component as positioned in the wall, all or a desired portion of the inner horizontal and vertical cavities may be filled with bonding material. These filled cavities may be positioned to form a total inner grid pattern. However, such insulated load-bearing walls of the prior art have not been capable of having mortar pumped into the inner horizontal cavities of the assembled wall and properly bonding all the insulated components together.

The advent of the so-called energy crisis and the inflated and still rapidly growing cost of construction, mandate that the aforementioned problems be solved. Furthermore, new minimum insulative values, e.g. R-19, and higher, must be reqiured for walls constructed in most locales.

Therefore, there is an acute need for a self-aligning building component adapted for quickly forming load-bearing, insulative walls. Preferably, such a component should provide simple and accurate means for self alignment of the components in a load-bearing relationship, while presenting a high insulative value—a combination never before achieved in a component wall. Further, the component should lend ease in manufacturing and consistency in dimensions, structural integrity and insulative value.

SUMMARY OF THE INVENTION

According to the present invention there is provided a novel building component comprising a body portion defining top and bottom surfaces, interior and exterior wall surfaces, and end surfaces adapted for abutting engagement in rows of a wall to be formed with multiple building components; at least one vertical opening formed in said body, said opening including insulating material which protrudes by a predetermined amount from at least one of said top and bottom surfaces of said body and is adapted to engage the opposing surface of the overlying or underlying components; fluid bonding material containment ridges formed on the top and bottom surfaces along both the inner and outer walls; fluid bonding material flow canals defined by said containment ridges and the borders of said protruding insulation; at least one vertical core which, when multiple building components are assembled to form a wall in a designed overlapping manner, will align with vertical cores in underlying and overlying components to define a vertical path throughout the height of the wall; said vertical path communicating with said canals and being adapted to receive fluid bonding material; whereby fluid bonding material may be introduced into said vertical path into communication with said canals to fill said canals with a desired volume of bonding material at the interface between the adjoining rows of building components in a wall.

In accordance with one embodiment, the building component may define truss-shaped canals which, in conjunction with the internal component structure, serve as continuous trusses throughout the height of the wall.

According to another embodiment, the building component may include inside and outside component portions separated by insulating material in the vertical opening and connected by rigid structural members embedded in the insulation. This insulation may occupy all or part of the inner cavity which may leave part of the rigid structural members exposed, creating a greater vertical and horizontal opening for bonding material.

In accordance with the present invention there is also provided a wall comprising: an interior surface; an exterior surface; internal vertical paths running the height of the wall and being filled with bonding material; horizontally repetitive canal patterns formed within the wall at regular vertical intervals so that the repetitive patterns substantially overlie each other; canals of said canal patterns being in fluid communication with said internal vertical paths and being substantially filled with bonding material; at least one internal vertical opening disposed between said interior and exterior surfaces throughout the length of the wall; and a vertically aligned truss structure joining said interior and exterior surfaces.

The wall of the invention may be formed by uniform building components assembled in overlying rows to define the vertical paths and horizontal canal patterns. Furthermore, at the vertical interface between abutting building components there may be defined vertical canals in fluid communication with the horizontal truss-forming canals.

In another aspect, the present invention defines a method of constructing a wall comprising the steps of assembling building components in overlying rows; said building components being of the type having at least one vertical core therein which, when multiple building components are assembled to form a wall in a designed overlapping manner, will align with mating vertical cores in underlying and overlying components to define a vertical path throughout the height of the wall, said building component further including horizontal canals defined by containment ridges formed along the inner and outer walls and by the borders of protruding insulation material; pumping bonding material into the vertical paths by nozzles; and filling the vertical paths and horizontal canals with bonding material.

The defined method may include the further step of pumping a resilient fluid material into the vertical paths at selected longitudinal intervals to define control joints. Also, the method may include the step of inserting vertical reinforcement rods in selected ones of the vertical paths. You can optionally place horizontal tie mesh prior to completion of the wall row by row as desired. Pumping would still follow as the same procedure—completely filling the inner voids.

DETAILED DESCRIPTION OF THE INVENTION

Figure 1:
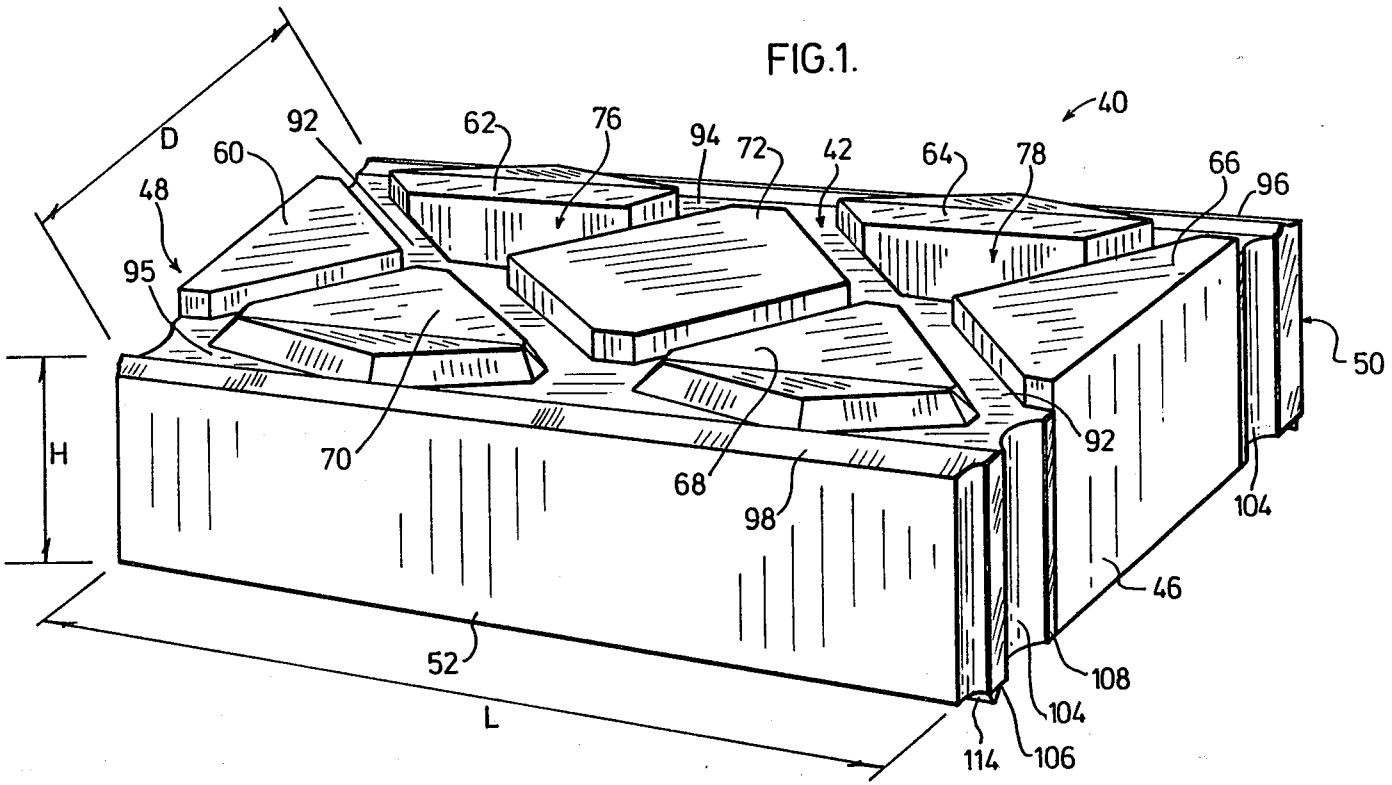
FIG. 1 is a pictorial top view of one embodiment of the building component of the instant invention.

An illustrative embodiment of the building component of the instant invention will now be described with reference to FIGS. 1–11. Like reference numerals will refer to like elements throughout the description.

The building component 40 is a generally box-shaped component which may, in a particular embodiment, have a length dimension L on the order of 12 inches, a height dimension H on the order of 3 inches, and a depth or thickness dimension D on the order of 10 inches, while it will be appreciated that the invention is not so limited.

Building component 40 includes a top surface 42, a bottom surface 44, end surfaces 46 and 48, an interior wall surface 50 and an exterior wall surface 52.

Figure 22:
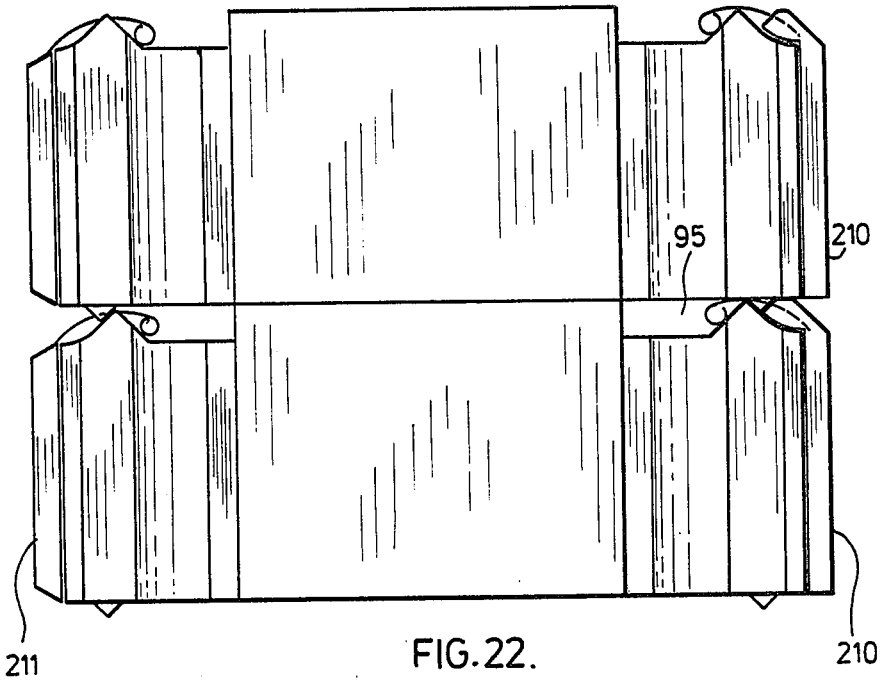
FIG. 22 is an end section view through an alternative building component of the instant invention, similar to the section view of FIG. 5, showing the additional optional feature of a face plate secured to the outer face of each component and tied within the outer horizontal canal.

Interior and exterior surfaces 50, 52 are substantially planar and, as explained below, they may be plain, etched or texturized or covered with face plates (FIG. 22). As shown in FIGS. 1–4 building component 40 is formed with a plurality of vertical openings 60, 62, 64, 66, 68, 70 which are filled at least in part with suitable insulating material. As best shown in FIG. 3, the insulation material substantially fills vertical openings 60, 66, 68, 70 and 72. The insulating material only partially fills cavities 62 and 64 leaving vertical cores 76, 78 respectively. As explained below, once a wall or wall portion has been initially assembled by forming halfway or 50% overlapping rows of self-aligning building components 40, nozzles attached to hoses of bonding material pumping machines may be inserted into vertical cores 76, 78 to complete the formation of the wall, as mortar fills the inner voids.

As best shown in FIG. 1, the insulating material in vertical openings 60, 62, 64, 66, 68, 70, and 72 is positioned in the respective openings so as to protrude a predetermined distance above the top surface 42 of building component 40. In the case of the described building component having the dimensions of 12 inches by 3 inches by 10 inches, this predetermined distance may be on the order of ½ inch. It will be noted from FIG. 2 that the insulating material is preferably flush with the bottom surface 44. It will be appreciated that the insulation may protrude from both the bottom and top surfaces, or from the bottom surface only.

Figure 2:
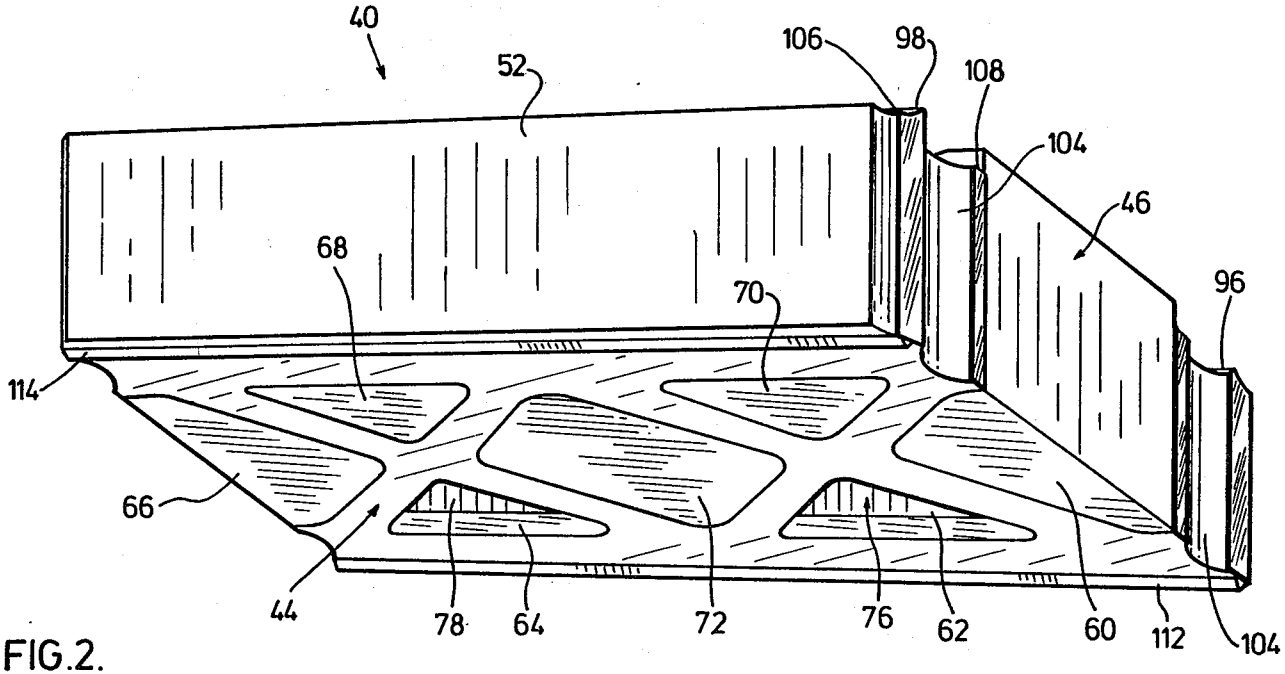
FIG. 2 is a pictorial bottom view of the building component illustrated in FIG. 1.
Figure 3:
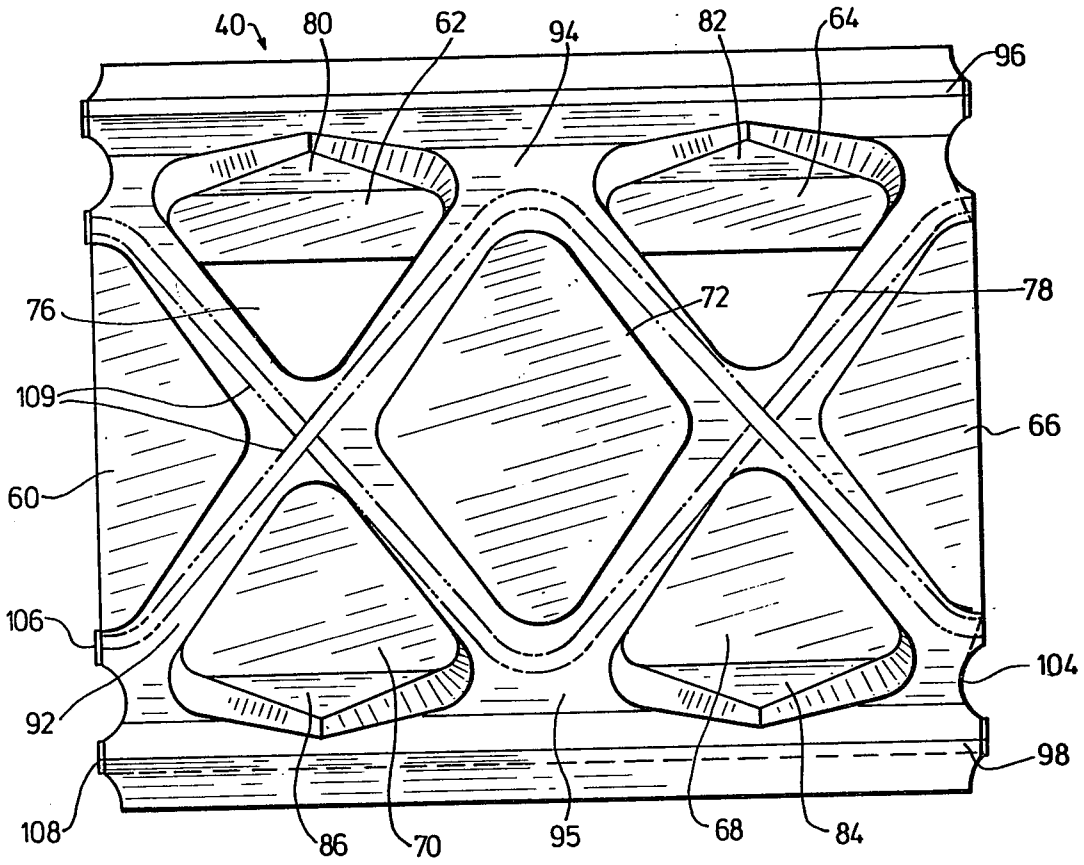
FIG. 3 is a top view of the building component illustrated in FIGS. 1 and 2.

Since various forms of the insulating material which may be utilized in accordance with the present invention are for most circumstances unsuited for serving a weight-bearing function, the building component 40 includes rigid height stabilizers 80, 82, 84, 86 (FIG. 3) having planar tops and formed adjacent vertical openings 62, 64, 68, 70 (FIGS. 1, 2 and 3). The height stabilizers are formed to protrude a predetermined distance above the top surface 42 of building component 40 and to engage the bottom surfaces 44 of overlying building components 40 when placed in position in the wall. The height stabilizers serve as means for supporting the weight of overlying rows of components prior to the addition of bonding material and its setting. Other such means are described in connection with the written description of alternative embodiments, below.

Although the invention is not so limited, it is preferable that the height of the height stabilizers 80, 82, 84, 86 be equal to the height of protrusion of the insulating material in vertical openings 60, 62, 64, 66, 68, 70, 72. When building component 40 is constructed in this fashion, the top surfaces of the insulating material are adapted to support and meet sealingly the bottom surfaces of the insulating material in the overlying building components, thereby forming continuous insulation columns and decreasing the thermal conductivity across the breadth of the building component 40.

As best shown in FIGS. 1, the height stabilizers 80, 82, 84, 86 taper back to the top surface 42 in a direction generally toward the interior and exterior surfaces 50, 52 at a selected angle of inclination, optimally 45°, and preferably within a range of 30° to 90°.

In the construction of building component 40, the height stabilizers 80, 82, 84, 86 may be coated with a semi-hard coating, for example a plastic or rubber composition, to serve as a top face coating which may be ground to the desired planar level to assure consistent accuracy preferred for rapid construction. The provision of the facings may, in certain manufacturing operations utilizing various compositions for the component 40, serve the useful purpose of compensating for wear in the dies forming the component so that by the provision of the facings and the subsequent grinding of said facings to the correct planar level, the building components may be constructed with a remarkable degree of uniformity in the upper weight-supporting surfaces thereof. It will be appreciated that the building component may be constructed without such facings without departing from the spirit or scope of the present invention and that in many applications of the invention the facings will not prove necessary. Even when made of the primary component material, the height stabilizers may still be ground if need be. The top face coatings further provide temporary support to the above components until the bonding material hardens. The bonding material when hardened forms the true load-bearing support. In the control joints (described below) which are filled with a rubberized compound, the facing helps to form an interface to easily allow freedom of movement horizontally and vertically when applied to the tops and/or ends of the component.

Figure 5:
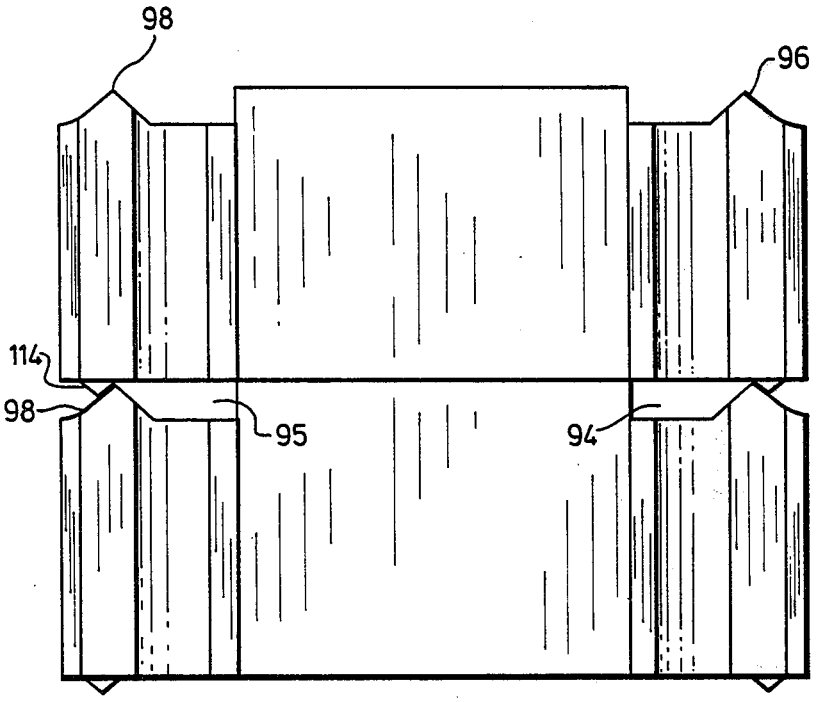
FIG. 5 is a section view through two stacked building components taken substantially along line 5—5 of FIG. 10.
Figure 6:
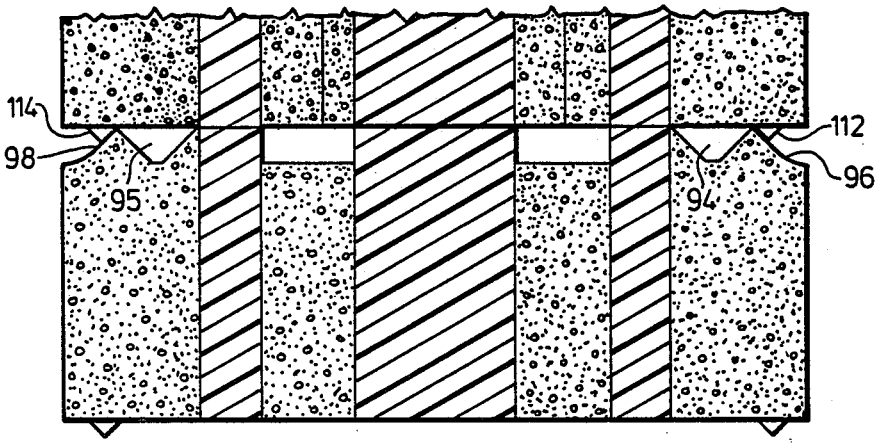
FIG. 6 is a section view, similar to FIG. 5, taken substantially along line 6—6 of FIG. 10.
Figure 7:
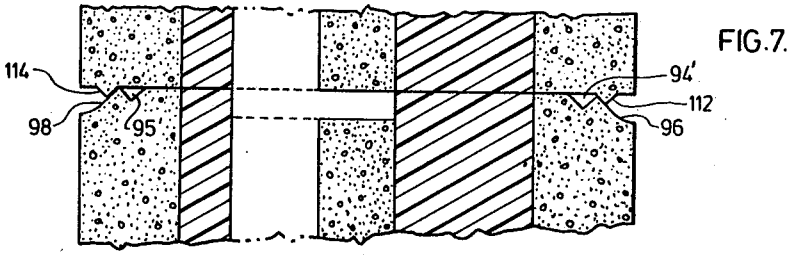
FIG. 7 is a section view, similar to FIGS. 5 and 6, taken substantially along line 7—7 of FIG. 10.

The protruding insulating material and height stabilizers serve to define an interconnecting horizontal canal pattern comprising inner canals 92 which, as best shown in FIG. 3, intersect to form a substantially X-shaped or truss-shaped pattern. The inner canals 92 are in communication with inner and outer canals 94, 95, respectively. The inner and outer canals 94, 95 are defined by inner and outer alignment-containment ridges 96, 98, respectively. As best shown in FIGS. 5, 6 and 7, alignment-containment ridges 96, 98, in conjunction with the insulating material, form the canals 94, 95 which vary in cross sectional area along their length due to the protrusion of the height stabilizer inclined sidewalls into the areas.

Figure 8:
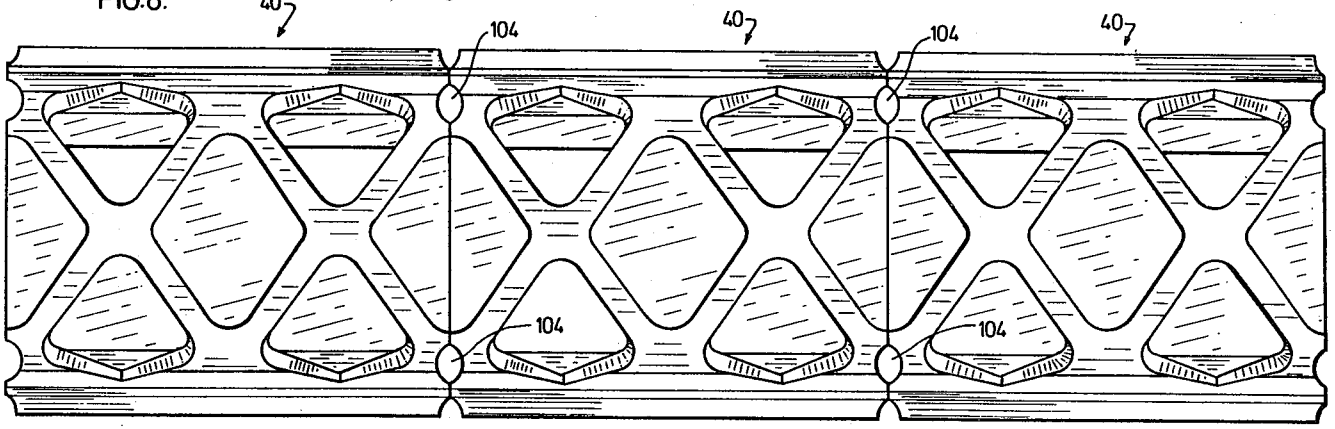
FIG. 8 is a top view of a portion of a wall constructed with building components of the instant invention as shown before pumping of the bonding material.

When layers of building components 40 are formed into a wall, the canals 92, 94, 95 are in fluid communication with vertical canals 104 formed at the interface between adjacent components 40 in the same row (FIG. 8). The vertical canals 104 are defined by the approximately semicircular-in-cross-section cut-out portions extending throughout the depth of the building components 40 substantially at the four corners thereof. The engagement of the adjacent semicircular-in-cross-section vertical openings which adjoin to form the substantially cylindrical vertical canals 104, are defined by exterior vertical contact surfaces 106 and interior vertical contact surfaces 108 (FIGS. 1 and 3). As with the height stabilizers 80, 82, 84, 86, the vertical contact surfaces 106, 108 may be provided with facing material of, for example, plastic or rubber, which may be ground down to a precise planar level to accommodate for any unacceptable tolerances in the manufacturing operation, due, for example, to wear in the dies. (Unacceptable tolerances may also result from inconsistencies in the mix materials which can cause variable shrinkage rates.) As with the horizontal facings 90 on the height stabilizers, the vertical facings are optional.

Figure 4:
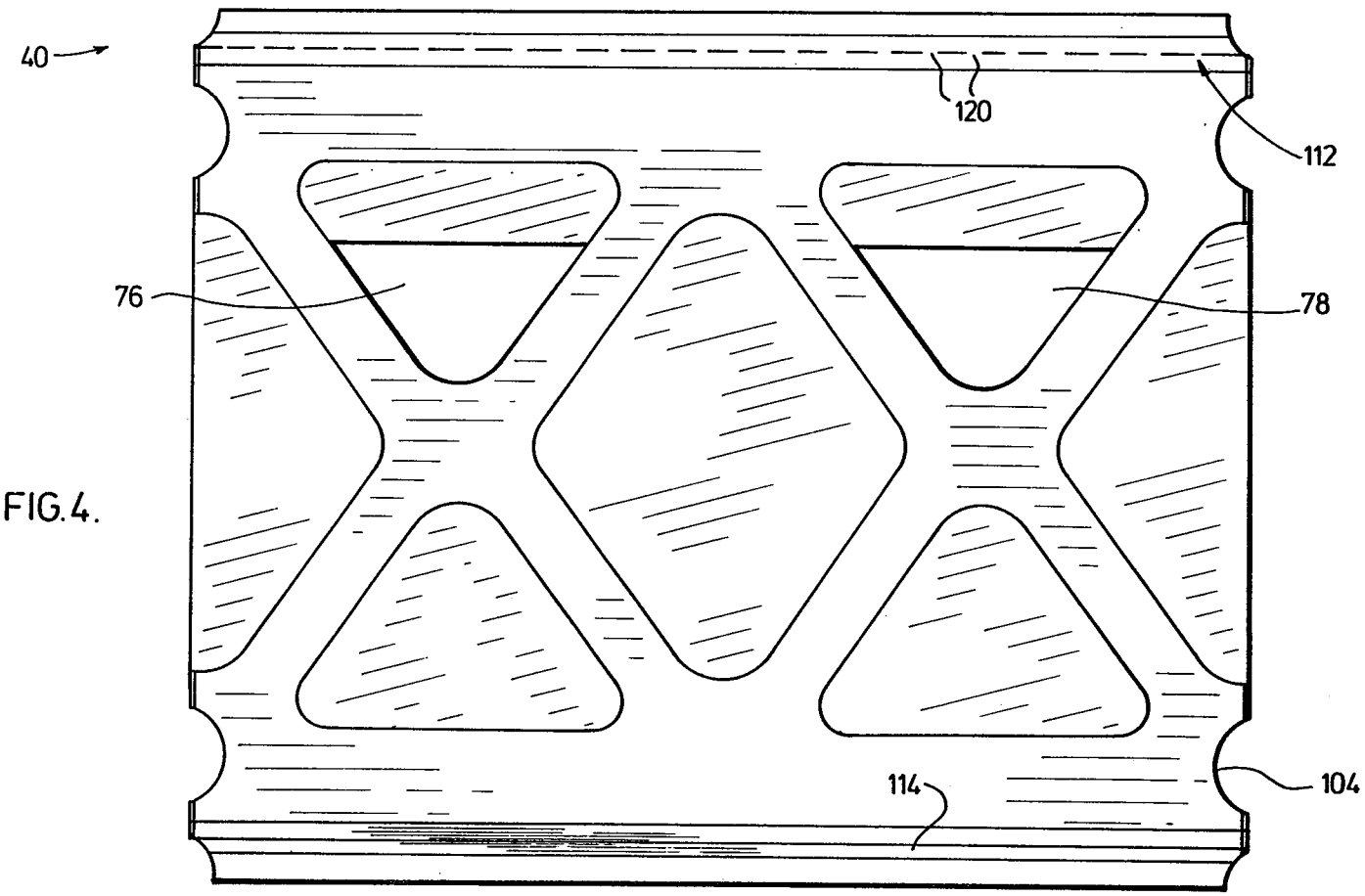
FIG. 4 is a bottom view of the building component illustrated in FIGS. 1–3.

As shown in FIGS. 2 and 4, the bottom surface 44 of component 40 is substantially planar except for the lower alignment-containment ridges 112, 114. As overlying rows of a wall are constructed in accordance with the instant invention, the lower alignment containment ridges 112, 114 are adapted to engage the upper alignment containment ridges 96, 98 on the underlying building components 40 (see FIGS. 5, 6, 7). The engagement of the respective alignment-containment ridges, serves, as the designation implies, to laterally align the adjacent rows of the building components during their assembly. Furthermore, during the pumping of mortar into the wall, the engagement of these ridges serves to contain the mortar within outer canals 94, 95. As shown in FIGS. 5, 6 and 7, it is preferable, but not critical in all applications, that the apexes of ridges 96, 98 not engage the bottom surface of the overlying component 40, but rather that the bulk of the weight of the overlying components be carried by the rigid height stabilizers 80, 82, 84, 86. This ensures a good seal between insulation layers. Such a design provides more positive alignment by the engagement of the inclined surfaces of the alignment-containment ridges 96, 98, 112, 114. Furthermore, once the mortar has set the mortar will be capable of carrying the bulk of the load of overlying rows of components.

Although not illustrated, ridges 96, 98, 112, 114 may be formed with a substantially flat planar surface at their apexes instead of the pointed apexes depicted in the drawings. Such construction may serve to strengthen the ridges at their apexes and thereby prevent breakage at this point during construction.

Furthermore, it is desirable in many applications to provide air escape ports 120 in certain of the ridges (for example, ridge 112 of FIG. 4) in order to allow entrapped air to escape from the interior of the building components when the bonding material is being pumped therein. This feature ensures complete filling and stronger resultant walls. The ports 120 may also serve as access holes for probes (not shown) inserted after the pumping operation to ensure that positive filling of the canals has occurred.

Ridges 96, 98, 112, 114 may be provided with a deformable coating, or be made from deformable material, so that they may deform during so-called "hydration movement" of the components, i.e., the expansion and contraction of the components during changing dry and wet conditions. It is desirable that the lower alignment-containment ridges be made from a different material from that of component 40. Desirable materials, for example Uniroyal "flexible waterproof membrane", are those which will seal out water and thermal conductance (i.e. relatively heat insulative material), thereby protecting the internal bonding material to exposure to deteriorating weather conditions.

Figure 17:
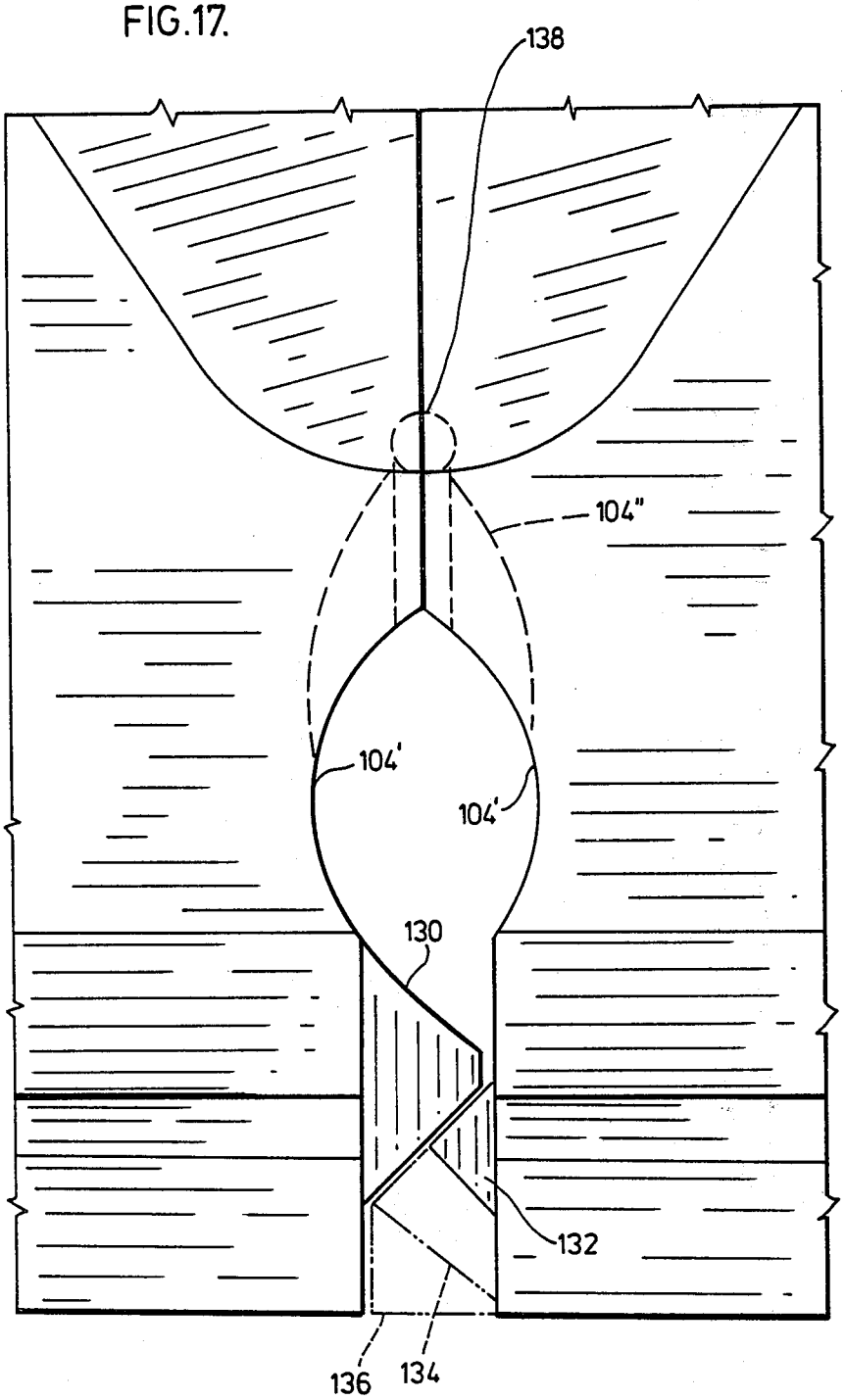
FIG. 17 is an enlarged top view of a portion of the interface between two adjacent building components' outer edges illustrating modified forms of the vertical canal and adjacent alignment-containment ridges of the type designed for use especially in those applications where the vertical canals receive mortar-pumping nozzles, the vertical canals holding within the full force of the pumped bonding material.

Because the fluid pressure of the bonding material in the vertical canals 104 during the pumping operation typically is somewhat less than that at the alignment-containment ridges, there may be, in some applications, less need for a substantially sealing interface along exterior and interior vertical contact surfaces 106, 108. However, as illustrated in FIG. 17 and as described in detail later in the description, alignment-containment ridges may be utilized along vertical contact surfaces 106 in order to minimize the likelihood of bonding material escape along that interface, especially in situations where the building component of the invention is designed to permit pumping of bonding material directly into the vertical canals 104.

As discussed in detail below, the shadow effect created at the horizontal interface between the alignment-containment ridges 96, 98, 112, 114 serves to provide an aesthetically appealing "mortar line" while the interface at vertical contact surfaces 106, 108 also serves to present a pleasing appearance.

Figure 9:
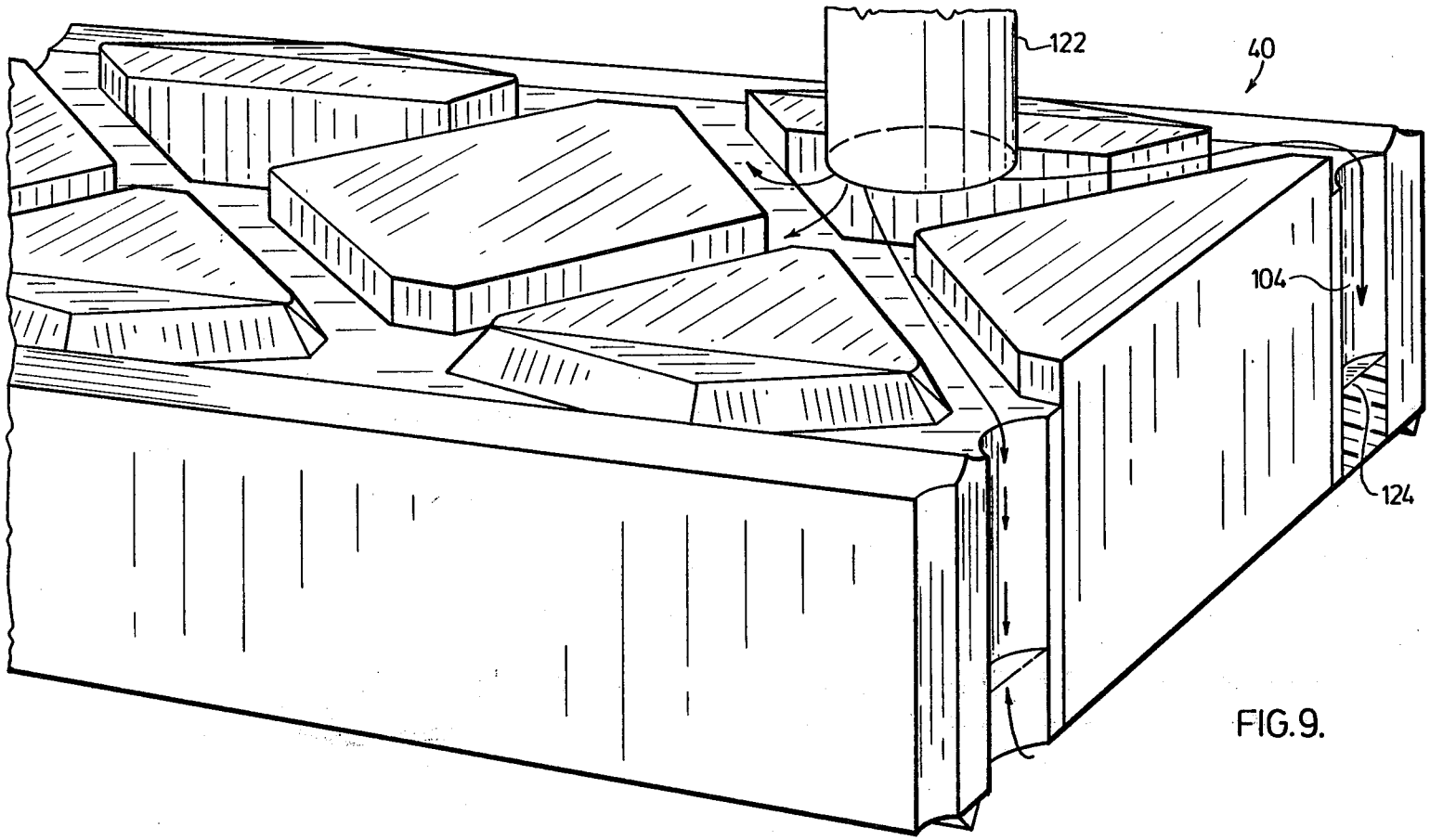
FIG. 9 is a pictorial representation of a building component of the instant invention illustrating the path of bonding material flow along the horizontal and vertical canals.
Figure 10:
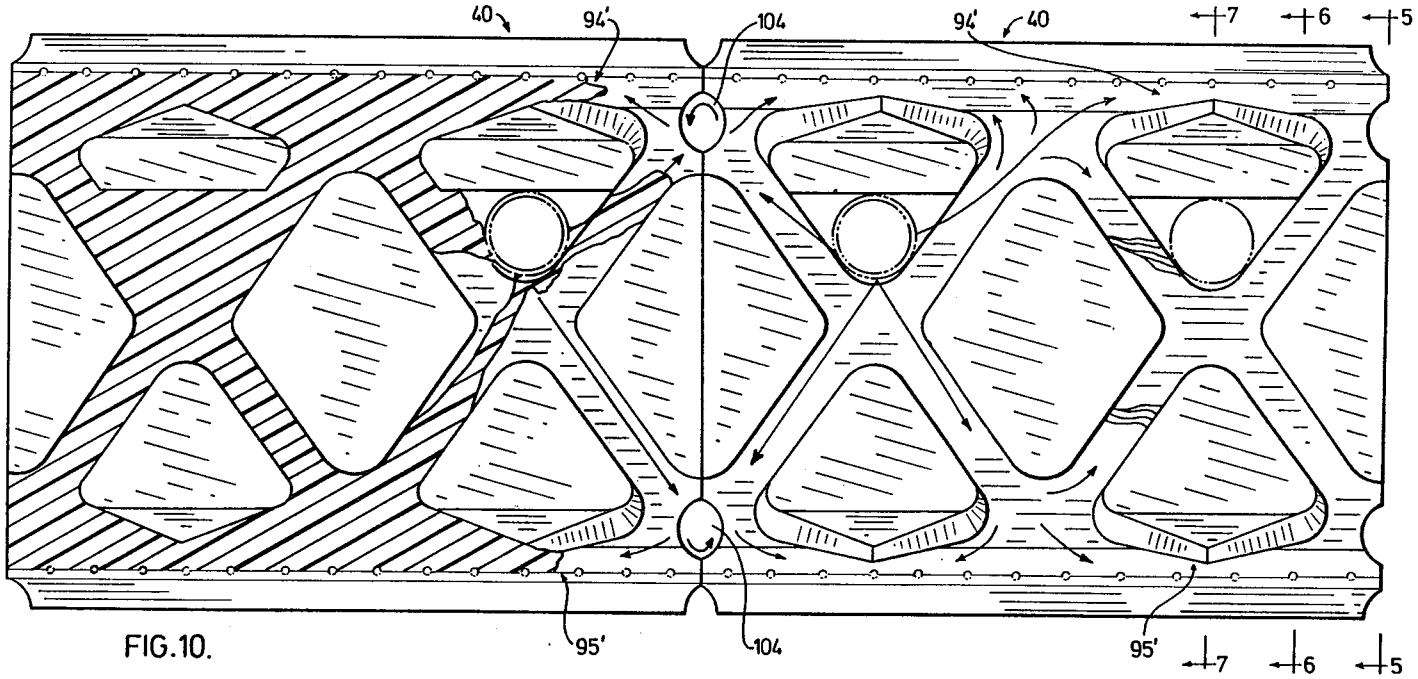
FIG. 10 is a top view of two adjacent building components illustrating, in the left portion thereof, the completed bonding material pattern achieved by pumping of bonding material through a vertical core and, in the central and right portions thereof, the intended flow paths for the bonding material from a pair of adjacent vertical cores, as would normally be supplied by two vertical nozzles lowered into any portion of the wall.

With reference to FIGS. 9 and 10, the description will now turn to a discussion of the pumping of bonding material, e.g. mortar, into an assembled wall of components 40. In a typical pumping operation, the pump nozzles utilized may comprise an adjacent pair of nozzles, or "tandem nozzles", connected to a suitable mortar pump wherein the nozzles are spaced apart by the distance between adjacent vertical cores 76, 78. According to a preferred manner of practicing the invention, the building components 40 as previously described are constructed in such a manner so as to be adapted to overlap 50% in adjacent rows so that the vertical core 76 of any component 40 aligns with the vertical cores 78 of the underlying and overlying components. Such an arrangement serves to present uninterrupted vertical paths throughout the height of the wall suitable for receiving the tandem nozzle configuration for bonding material pumping. Likewise, the insulation in vertical openings 72 is adapted to overlie (and underlie) the insulation volume defined by the abutting insulation in vertical openings 60, 66 of the overlying and underlying components to define continuous vertical columns of insulation.

Referring to FIG. 9, wherein only a single nozzle is depicted for ease in illustration and description, a nozzle 122 is shown as it is being raised so that its outlet port is proximate the top surface 42 of the depicted building component 40. It will be understood that according to the preferred method of pumping bonding material, the tandem nozzles are initially inserted to the lowermost portion of the wall portion which has not previously received bonding material, and then gradually raised as the bonding material fills the canals 92, 94, 95. As depicted in FIG. 9, the nozzle 122 has pumped bonding material at the interface between the depicted building component 40 and the underlying layer so that a volume 124 of bonding material has been pumped up into the vertical canals 104. This occurs when the canals below are totally filled, thereby pushing the nozzle upwards due to the back pressure and allowing some bonding material to rise up into the vertical canals 124, prior to the rest being filled from above, a moment later.

FIG. 9 depicts by arrows the flow pattern which the mortar takes as the nozzle exit port arrives at the top surface 42 of building component 40. It will be understood that the overlying building components are not illustrated for purposes of simplicity although such components do, in fact, serve to confine the flow of the bonding material along the illustrated canals. (This is due to the bottom of the above component presenting a flat, flush meeting surface with the protruding insulation as shown in FIG. 5). As shown, the bonding material is free to flow in the canals 92, 94, 95 defined by the top surface 42 of component 40 and the protruding insulation and the alignment containment ridges 96, 98 and, at the corners of the respective blocks, downwardly and upwardly from top surface 42 into the vertical canals 104.

FIG. 10 shows two adjacent building components in a row of a wall during the pumping operation with the overlying layers of components removed for purposes of illustration. As shown, the pumping of bonding material has occurred in the left one of the four depicted vertical cores. The bonding material exiting from the left vertical core has substantially filled the canals 92, 94, 95 extending outwardly from such core. It will be noted that at the constricted areas 94', 95' (FIGS. 7 and 10) defined by the alignment containment ridges 96, 98 and the opposing inclined wall surfaces of the height stabilizers adjacent the second from the left vertical core, a sufficient back pressure has been created to substantially stop the flow of bonding material along the ridges 96, 98. This back pressure serves to prevent the additional flow of bonding material into the canals at the desired bonding material fluid pressures so that the nozzle will essentially automatically rise in the core due to the back pressure. This phenomenon also allows the builder to keep certain cavities free of bonding material so that utility lines and the like may be installed in the unfilled cavities.

The back pressure condition created at constricted areas 94', 95' serves the additional function of facilitating the insertion of vertical "control joints" in the wall at selected horizontal intervals. Such a control joint may be constructed simply by pumping a rubberized or other control joint material into one vertical core, or a selected number of adjacent vertical cores. The back pressure assures that the specially pumped control joint material fills only a discrete volume between laterally disposed constricted areas 94', 95'. The control joint allows expansion and contraction of the wall without the unsightly visible control joint lines associated with most means for forming control joints according to prior art methods. Furthermore, unlike conventional control joints, the control joints of the present invention serve to substantially surround the involved building components with control joint material for more reliable and flexible expansion and contraction in all directions. It will also be noted, that with the use of deformable material for any or all of alignment-containment ridges 96, 98, 112, 114 or for the vertical contact surfaces 106, 108, a degree of deformability to accommodate expansion and contraction may be achieved throughout the wall.

Following the pumping of bonding material into the left core illustrated in FIG. 10 (and the core to its left, not illustrated), the tandem nozzles will be inserted into the two central cores of FIG. 10 with the pumping commencing at the lowermost portion of the wall which has not previously been filled with bonding material. FIG. 10 illustrates by the arrows emanating from the two central cores the path which the bonding material will take when the discharge ports of the tandem nozzles reach the level of the building components illustrated therein. It can be seen that the bonding material will fill in substantially back to the previously injected bonding material from the left core and will fill toward the right to the constricted area defined by the ridges 96, 98 and the height stabilizer inclined walls adjacent the right core such that the bonding material flow will stop substantially at the section line designated 7—7. It will also be appreciated that the bonding material pumped through the two central cores of FIG. 10 will flow into the two vertical canals 104 centrally located in FIG. 10 in both a downwardly direction and an upwardly direction.

It can be seen that in the embodiment described above the pumped-in bonding material forms a solid continuation of the component truss structure to lend remarkable strength to the component for withstanding both vertical and lateral loads on the wall. Furthermore, a wall made from these components demonstrates excellent load carrying capabilities arrived at by properly filling the outside horizontal canals 94, 95.

Also it can be seen that the completed wall has a remarkable design, not only for strength and efficiency of construction, but also for providing thermal insulation between the inside and outside wall surfaces. More particularly, it can be seen that there is a very small "thermal bridge" so that heat transfer may less readily occur between the inner and outer surfaces of the wall. In fact, it has been found that with the described 12 inch by 3 inch by 10 inch block defined above, utilizing approximately four inches of polyurethane foam, at a 2 lb mix as the insulating material, that an R-value on the order of 16 to 18 may be obtained utilizing conventional crystallized silicate aggregate (for example, concrete or clay) as the primary base material for the building component 40. With other embodiments designed to accentuate insulation characteristics, e.g. component 250 of FIG. 32, R-values on the order of 26 to 35 may be obtained. Of course, R-values vary with component width.

The strength of component 40 may be enhanced by including rigid truss reinforcement in the form of bars 109 (FIG. 3) which are embedded in the body of the component.

Figure 11:
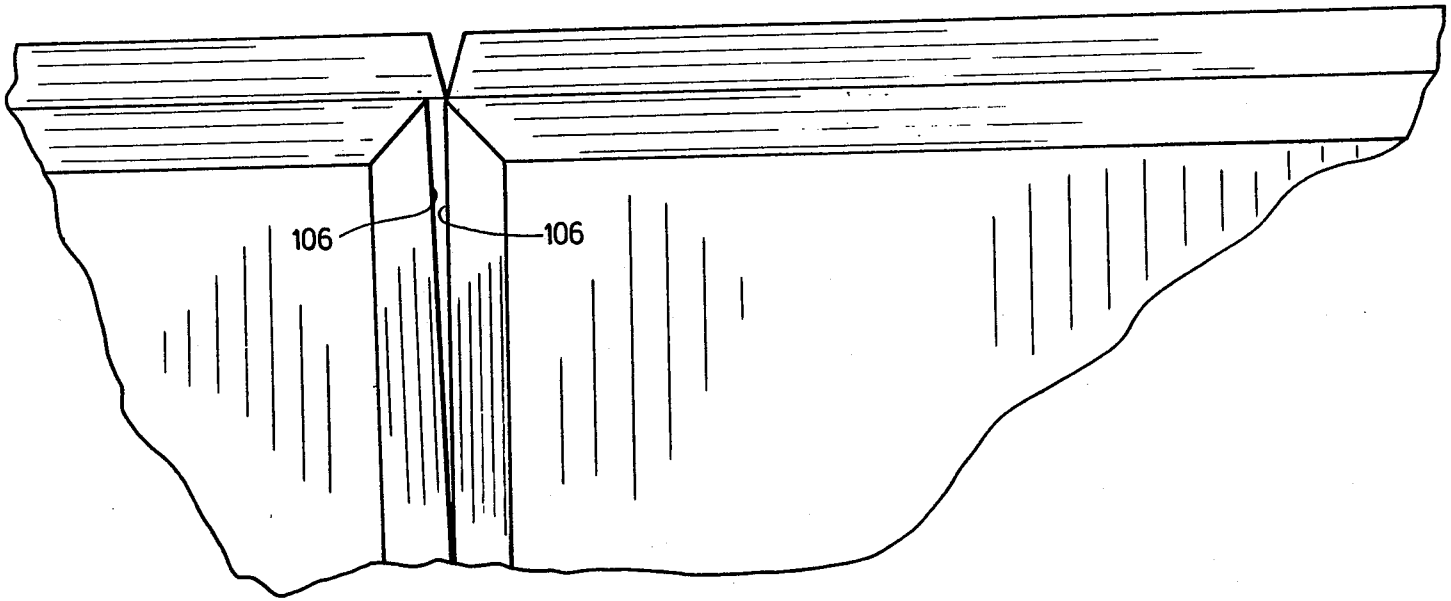
FIG. 11 is an enlarged side view of the outer vertical interface between two building components showing the tapered space between such components which permits the escape of air during the pumping of bonding material.

FIG. 11 is an enlarged view of the vertical interface between exterior vertical contact surfaces 106 which serve to define the vertical canals 104. As shown, the contact surfaces 106 are inclined somewhat apart from each other to form a gradually enlarging gap from the bottom to the top thereof. It has been found that this gap, formed by the opposed tapers which may be conveniently designed into the building component 40 to facilitate removal of the components from the molds, serves the desirable function of permitting escape of air from the vertical canals 104 during pumping of bonding material therein. Therefore, in the embodiment illustrated in FIG. 11, there are usually no surface coatings applied to the contact surfaces 106, but rather the surfaces are allowed to form a small gap to serve the above-mentioned function. However, where surface coatings are used they may be tapered similarly, or other air relief means (not shown) may be provided.

Figure 12:
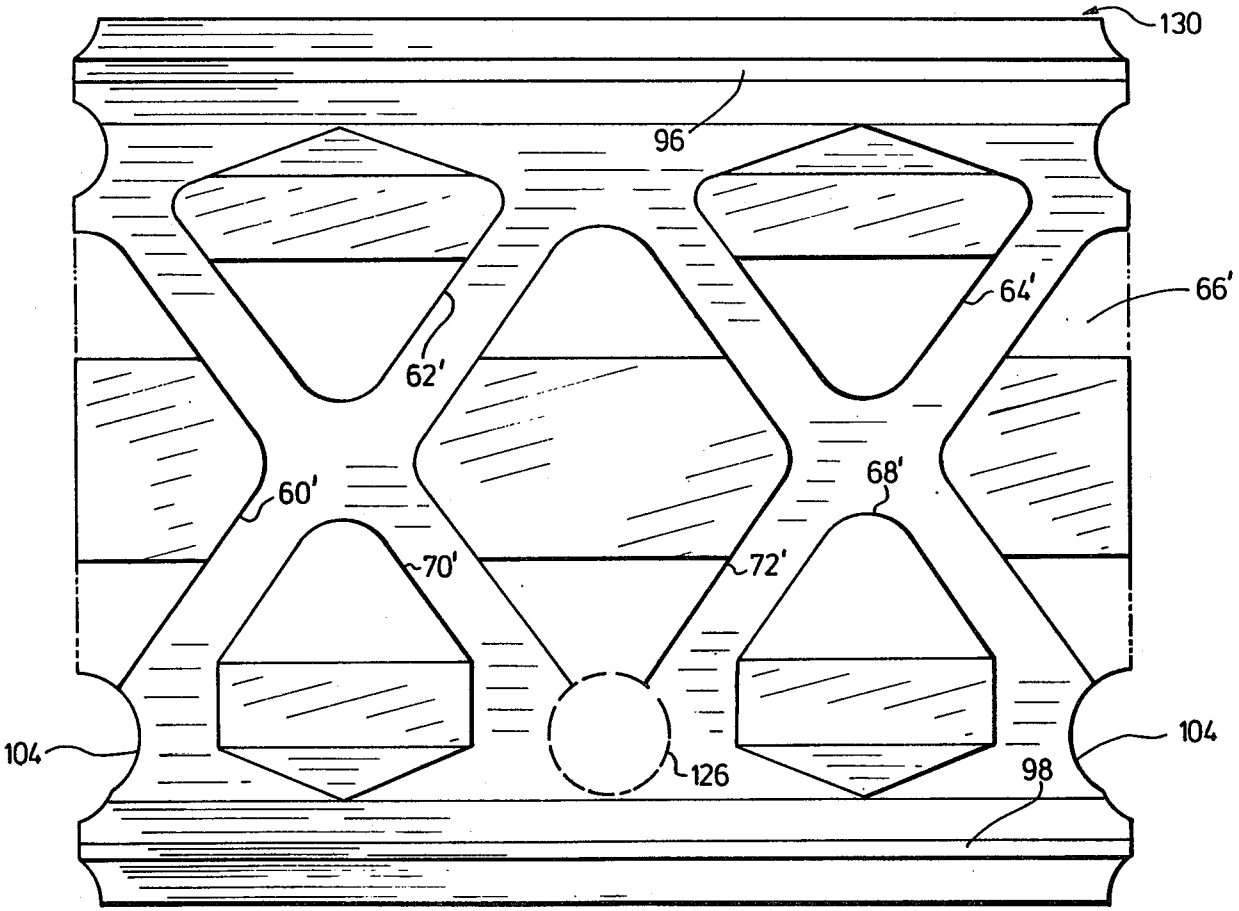
FIG. 12 is a top view of an alternative building component of the invention substantially similar in vertical-opening design to the component illustrated in FIG. 3 with different insulation placement and the addition of an outward centrally disposed cylindrical vertical core 126 permitting the pumping of bonding material into such core in conjunction with simultaneous pumping into the on-line vertical canals.

FIG. 12 illustrates an alternative embodiment for a building component of the invention as designated by the reference numeral 130. With reference to the illustriation of building component 40 in FIG. 3, it can be seen that building component 130 is substantially similar in the formation of the canals and trusses therein to the previously described building component 40. However, it has been found that for certain applications, particularly for added wall strength, it is desirable to reduce the volume of insulating material within the vertical cores and to fill the space which would have otherwise been filled with insulating material with additional bonding material. Thus, it can be seen that the vertical spaces within cores 60', 66', 68', 70', 72' are only partially filled with insulation, thereby providing the alternative of either filling the remaining vertical void with bonding material or leaving the void empty. Any combination of cores 60', 66', 68', 70', 72' may be filled with bonding material. The empty cores may be used to carry anchor bolts when attaching roofs or different story levels to the walls. The cores may also be used as alternate insulation containers.

A further feature of building component 130 is that an additional vertical core 126 is formed adjacent the outer alignment-containment ridge 98. Core 126 is designed to have a cylindrical vertical opening substantially the same size as that defined by adjacent vertical canals 104. Thus, when the building components 130 are disposed in the 50% overlapping relationship in adjacent rows, vertical paths will be formed throughout the wall as defined by vertical cores 126 which will overlie and underlie adjacent vertical canals 104. Therefore, bonding material may be pumped into the vertical cylindrical paths defined by vertical core 126 and vertical canals 104.

Thus, it can be seen that building component 130 provides a number of possible combinations of vertical bonding material pumping paths as well as providing the option of adding additional bonding material or maintaining voids within the component if desired. Furthermore, the cores may be completely or partially filled with insulation inserts at the construction site.

Referring briefly to FIG. 17, there is shown an enlarged plan view at the interface between two adjacent building components of the invention having an alternative structure at the vertical canals 104'. The embodiment illustrated in FIG. 17 is one that can be used advantageously with a building component such as component 130 illustrated in FIG. 12 where mortar is pumped into the vertical canal 104 (or 104'). The structure of FIG. 17 provides the advantage of having vertical alignment-containment ridges 130, 132 which serve to reduce the likelihood of bonding material leaking through the vertical interface external of the vertical canal 104' when the pumping nozzle tube is lowered directly into the vertical canal 104'.

As shown by dashed line 134, the external vertical alignment-containment ridge may be enlarged to perform an enlarged seal which will be more desirable for certain applications.

Also shown in dashed lines in FIG. 17 is a second alternative configuration for the outer vertical alignment-containment ridge wherein the outer face of ridge 136 is substantially flush or coplanar with the outer surfaces of the adjacent building components. Ridge 136 may be desirable for use in underground basement or foundation uses of the components to prevent the "snagging" at the interface between adjacent components during shifting of the components relative to the soil. This is particularly useful during frost action and when heaving forces are operating against the outside of the wall.

The dashed lines in FIG. 17 depicting a continuation of an enlarged vertical canal 104'' depicts an alternative structure in which the interior vertical contact surface 108 has been eliminated so that the contact surfaces interior of vertical canal 104'' consists of the abutting insulation surfaces in the area designated by the reference numeral 138. Such a configuration is believed to have advantages when the insulating material is a relatively rigid material such as some commercially available urethanes.

Referring now to FIGS. 13, 14, 15 and 16, there are shown several alternative embodiments of building components constructed in accordance with the present invention. It will be noted that each such component maintains the advantages of vertically continuous truss-like formations defined by the inner and outer canals on the top planar surfaces, as well as excellent insulating characteristics.

Figure 13:
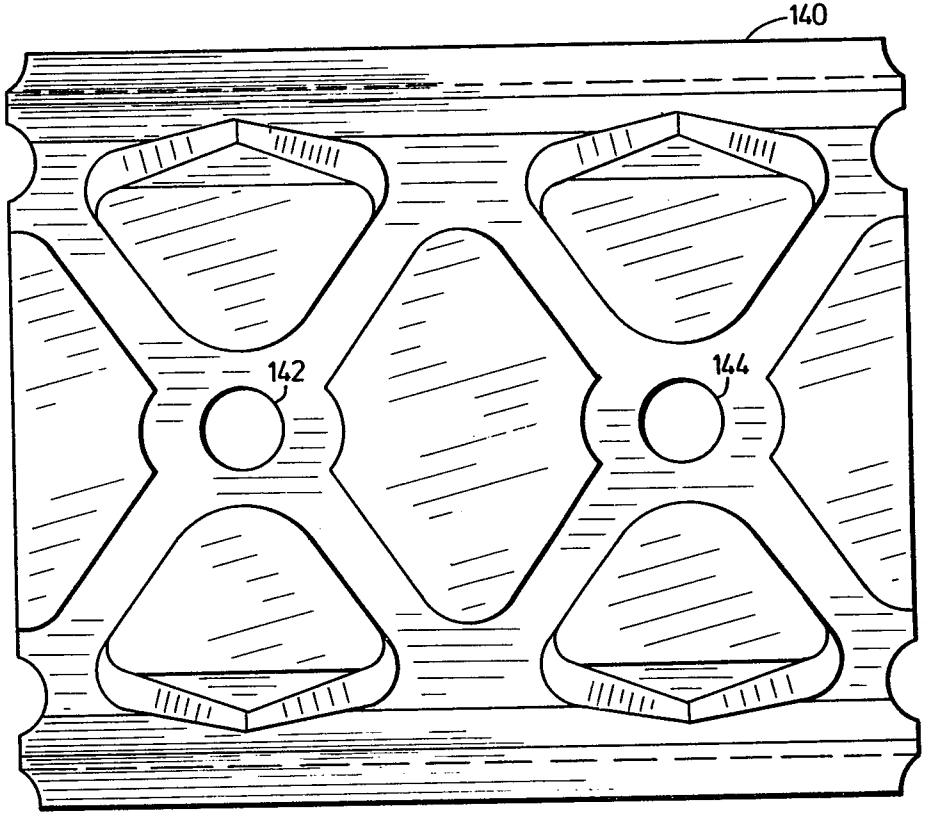
FIGS. 13, 14, 15 and 16 are top views illustrating alternative building components of the invention which maintain the basic truss and vertical core features of the invention while presenting advantages for varying building objectives and climates, and manufacturing facilities.

Turning first to FIG. 13, there is shown a building component 140 wherein the seven major vertical openings are entirely filled with insulating material with the two vertical openings for introducing of mortar comprising openings 142 and 144 which will overlap after assembling of adjacent layers in the 50% overlapping manner, to form vertical paths throughout the height of the wall. The building component 140 has the advantage of providing additional insulating material without sacrificing the strength and truss continuity obtained by filling the canals with bonding material.

Figure 14:
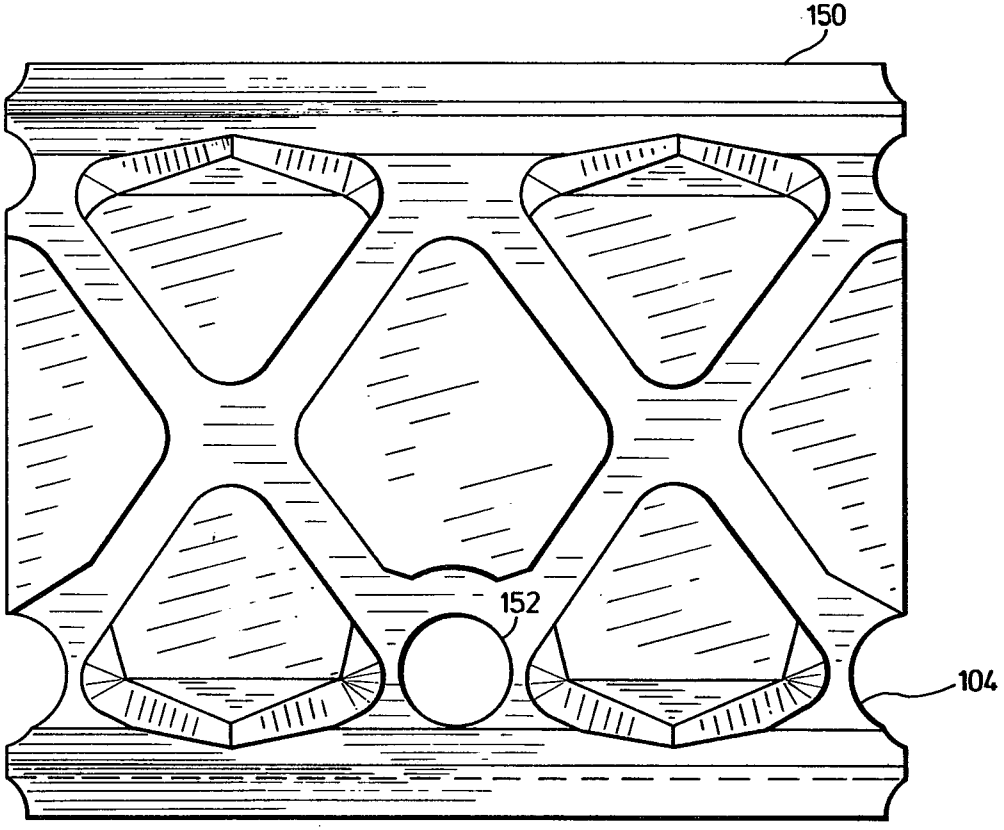

Building component 150 depicted in FIG. 14 combines several of the features of the components 130 and 140 depicted in FIGS. 12 and 13, respectively. Building component 150 has the advantage of completely filling the seven major vertical openings with insulation to give the enhanced insulating capacity. Furthermore, building component 150 includes a single additional vertical opening 152 which, in the manner described in connection with opening 126 of FIG. 12, provides vertical paths throughout the wall in conjunction with the vertical canals formed by adjacent openings 104 so that bonding material may be pumped into the canals in the manner illustrated and described in connection with FIG. 12.

Figure 15:
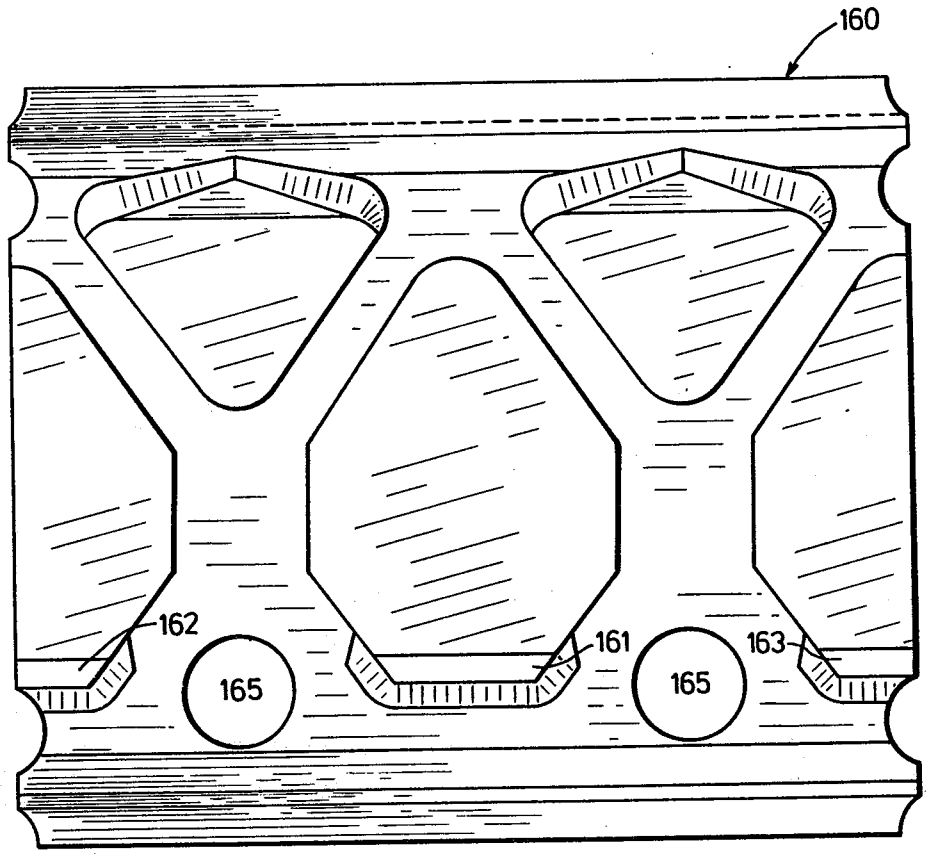

With reference to FIG. 15, building component 160 includes modified height stabilizers 161, 162, 163 and vertical cores 164, 165 which align to form vertical bonding material pumping paths in the assembled wall. The structure of component 160 results in greater overall strength.

Figure 16:
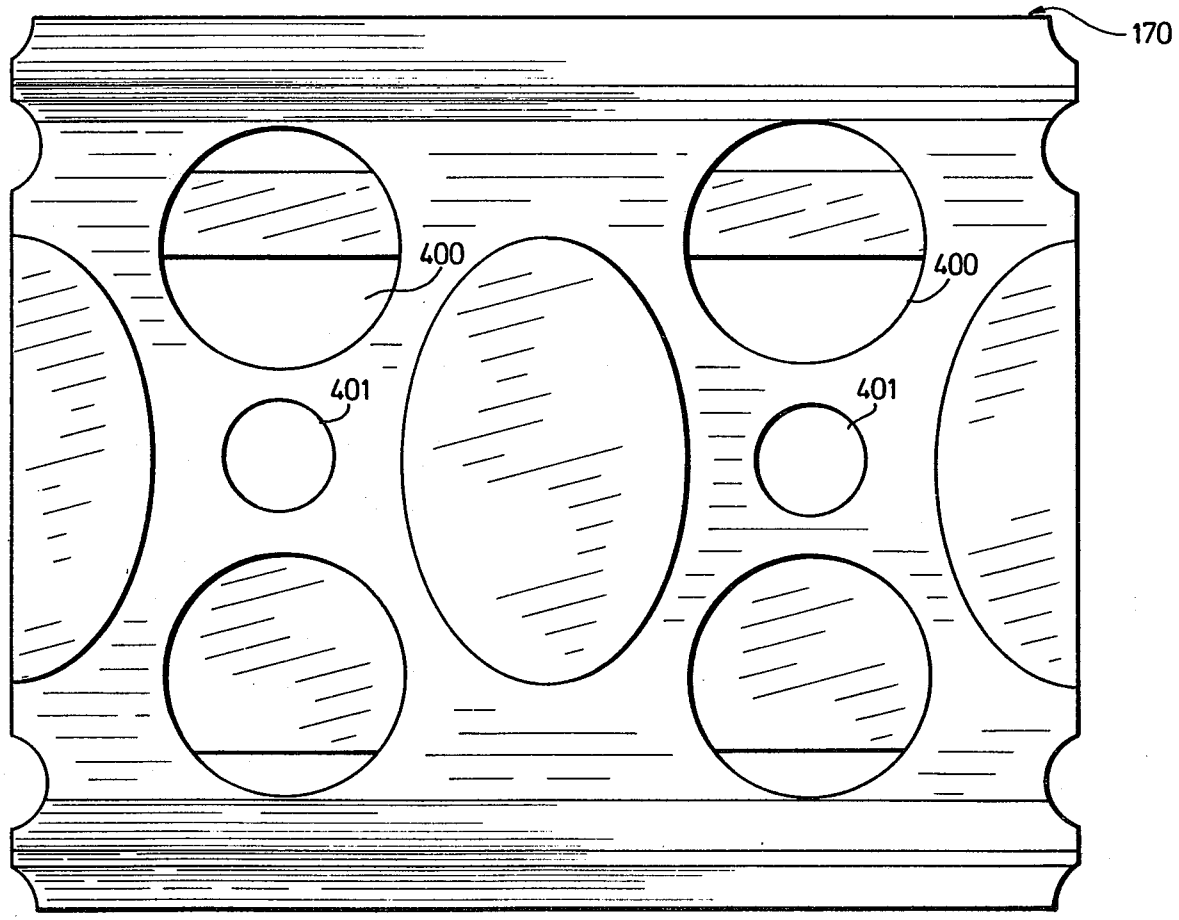

FIG. 16 illustrates yet another alternative building component 170 having vertical openings both circular and eliptical in cross section. This component still has the basic truss formation only more curved like an arch. Locations 400 and 401, if repeated on each of its adjacent sides either separately or jointly, will serve as vertical flow paths for the pumping nozzles. This design has the advantage of being relatively easy to manufacture.

Figure 18:
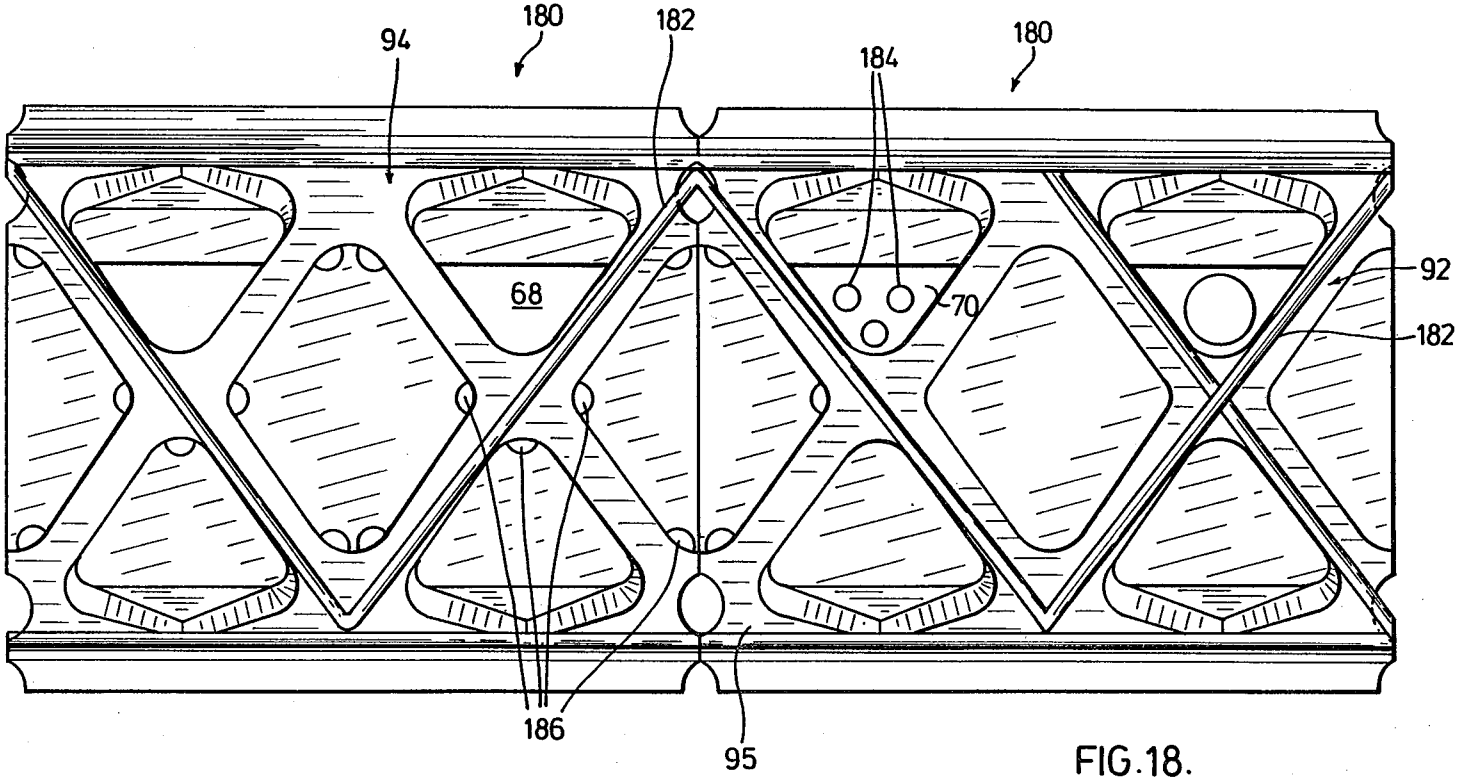
FIG. 18 is a top view of two adjacent building components of the invention prior to the pumping of bonding material and illustrates the optional features of reinforcement mesh in the horizontal canals, reinforcement rods in the vertical cores and vertical moisture drainage paths.

FIGS. 18–21 illustrate further alternative features which may be incorporated into the building components of the instant invention. FIG. 18 is a top view, similar to FIG. 8, of two adjacent building components 180 in the same row prior to the pumping of bonding material. Building components 180 are substantially the same as the previously described components 40 except for the following features. Components 180 include a reinforcement mesh 182 which is disposed in canals 92, 94 and 95. The reinforcement mesh 182 may take the form of a metallic wire mesh which is inserted into the canals after the components 180 are formed. The reinforcement mesh is advantageous in that it reinforces the trusses, continuations of which are formed by the bonding material in the canals and, therefore, adds significant additional strength to the completed wall. The mesh further serves to prevent horizontal movement of the wall caused by carbonation hydration, or other movements.

Building component 180 further includes vertical reinforcement rods 184 which may be disposed in any number of the vertical cores 76, 78, as desired, to lend reinforced strength to the finished wall. It will be understood, of course, that the vertical reinforcement rods 184 are inserted into the vertical openings 76, 78 after the bonding material has been pumped therein or, in the case of pouring or otherwise applying the bonding material, the rods 184 may be inserted beforehand or afterward. The rods add wall strength in restricting vertical movement and adding "point-load" pressure relief.

Building component 180 also includes vertical moisture drainage paths 186 which are formed preferably in the corner portions of selected ones of the vertical openings instead such areas being filled with insulation. The drainage paths 186 are adapted to receive moisture from walls erected in areas having particularly wet climates. The drainage paths 186 are aligned, as can be seen in FIG. 18, so as to overlap and provide vertical paths throughout the height of the wall when the building components 180 are assembled in the 50% overlapping relationship discussed above, or other designed overlapping orientation. The drainage paths aid in preventing water from entering the inside of the building. The paths also aid in thermal resistance as water vapor would otherwise emphasize the heat or cold—whichever is being preserved inside the structure.

Figure 19:
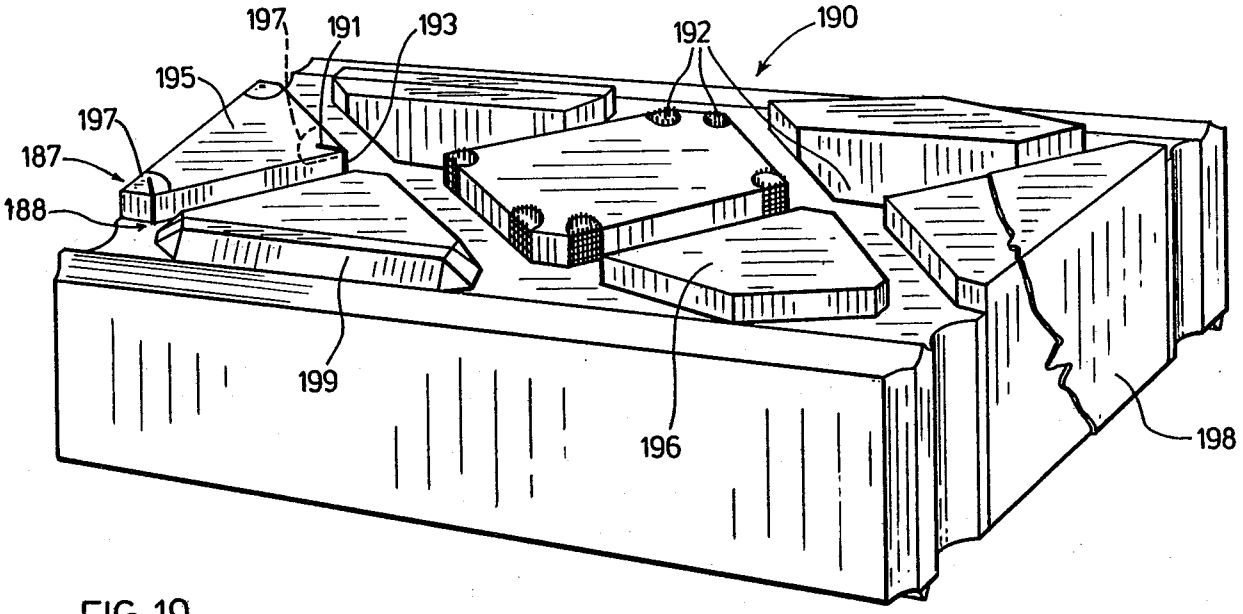
FIG. 19 is a pictorial top view of an alternative embodiment of the building component of the instant invention illustrating optional features including vertical moisture drainage paths having screen containment means, weight-supporting insulation in selected cores, and bar-height stabilizers embedded in the insulation in the left core of such component. Further shown is a support formed entirely of foam, which, by itself in certain limited applications, will serve the dual purposes of support and insulation.

FIG. 19 depicts yet another building component 190 constructed in accordance with the invention wherein the vertical moisture drainage paths 192, which are aligned vertically, are covered with a screen on the horizontal sides facing the canals to prevent their being blocked by flowing bonding material. The paths may be individually screen covered or wrapped in cloth just on the exposed inner canal wall. When a wall formed from either components 180 of FIG. 18 or components 190 of FIG. 19 are constructed in severe weather localities, a substantial portion of the water which penetrates from the outer wall will weep into the drainage paths before reaching the inner wall. Furthermore, the drainage paths may, in some instances, improve the long-term insulative value of the wall as the drainage paths serve to rid the wall of moisture which would otherwise, under certain circumstances, serve to decay the insulating material or, if entrapped within the wall and frozen, cause rupturing of the wall.

FIG. 19 further illustrates additional optional means for supporting the weight of overlying rows of components, for example, rigid insulation 195 which, in conjunction with other similar rigid insulations (not shown), are intended to serve the equivalent function of the height stabilizers 80, 82, 84, 86 illustrated in FIGS. 1 and 3. Rigid insulation 195 is held in place in its respective vertical opening by securement members 187 (three shown) comprising inverted L-shaped rod members 188 having arms 191 and 193. A cap 197 is secured to each arm 191 to engage the surface of the insulation. Similar securement members are located at the bottom surface of the components.

Building component 190 further includes an illustrative insulation panel 196 formed from a relatively rigid insulating material, for example, a tough urethane material, which can eliminate the need for separate height stabilizers at any point in a component utilizing such material throughout for insulation. The rigid urethane is best suited for applications where ultra violet deterioration is not a problem. Certain urethanes have sufficient rigidity to support the wall structure until such time as the bonding material is pumped into place and sets so that the insulation serves the dual purpose of providing heat insulation and means for supporting the weight of overlying rows of components. It will be understood that the insulating material 196 is shown in only one vertical opening in component 190 and that it is illustrative and exemplary of the insulation in a component wherein a substantial number of the openings include the relatively rigid insulating material which serves to support the weight of the components.

FIG. 19 also illustrates a cut-away portion of a protective jacket 198. Jacket 198 may be a water-tight jacket having as its primary purpose the prevention of moisture flow into the insulation. An example of a another jacket 198 would be a tar paper used to prevent ultra violet rays of the sun from deteriorating certain foam insulations. As another example, a rigid jacket may serve to rigidize the insulation material, further increasing its support characteristics. Finally, a foil may be used as the jacket to serve as a heat-shield, preventing the upward spreading of potential fire in the wall.

An additional feature illustrated in FIG. 19 is a height stabilizer 199 having a wall portion which is parallel to the adjacent alignment-containment ridge for the purpose of allowing a relatively free flow of bonding material in that area during pumping operations in applications where the creation of back pressure, described in conjunction with FIGS. 9 and 10, is not desired.

Figure 20:
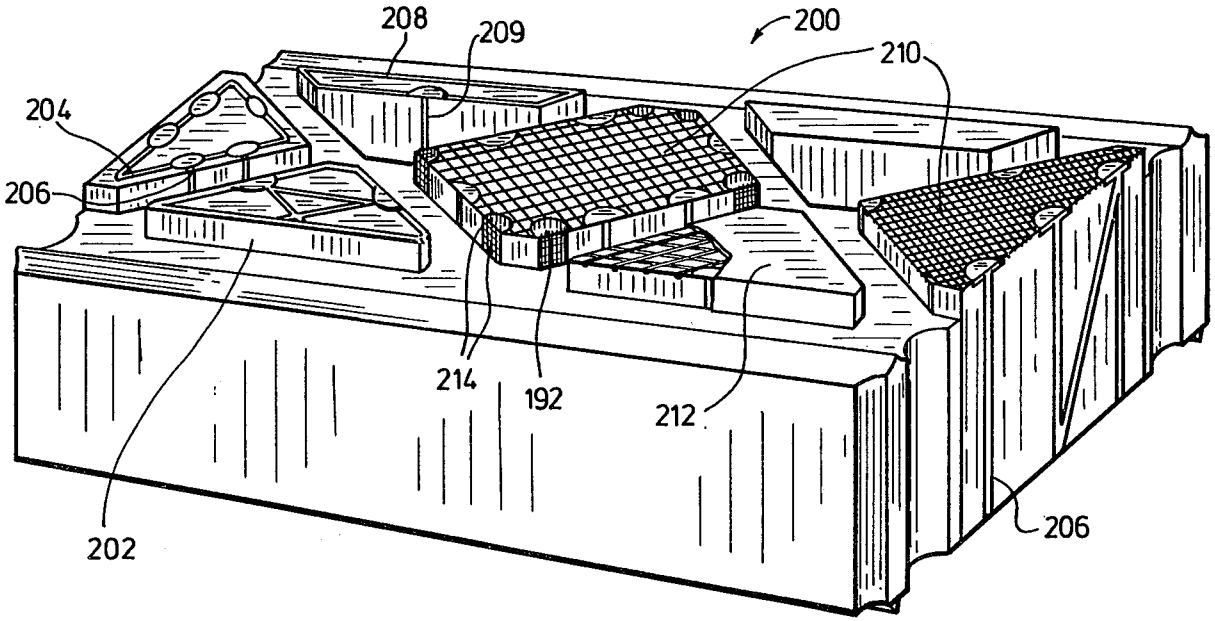
FIG. 20 is a pictorial top view of a building component in accordance with the present invention including various optional features for supporting the insulation within the vertical cores and for screening the vertical moisture drainage paths. Further shown is optional weather wrap protective covering surrounding the insulative material.
Figure 21:
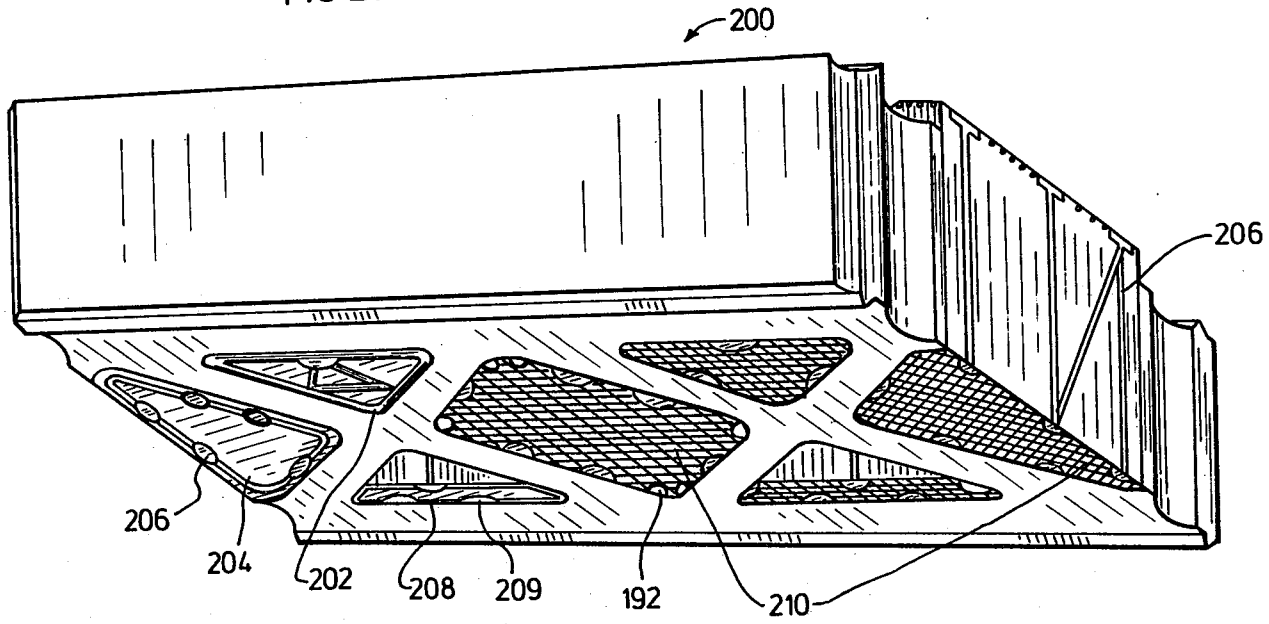
FIG. 21 is a pictorial bottom view of the building component illustrated in FIG. 20.

Turning now to FIGS. 20 and 21 there is illustrated yet another building component 200 constructed in accordance with the present invention and having a number of optional features which are advantageous in certain applications. Component 200 includes a thin supporting collar 202 which surrounds and supports the insulating material for lending additional support to less rigid varieties of insulating material so that the insulation material may serve the dual purpose of providing heat insulation and means for supporting the weight of overlying rows of components.

Also, component 200 includes a wire web support 204 which is embedded flush to the top of its insulation and which is supported internally by wire rods 206. Support 204 and rods 206 serve to substantially rigidify the insulating material and may, in certain applications, rigidify the insulating material to an extent such that separate height stabilizers 80, 82, 84, 86 are not necessary to support the weight of overlying rows of components. In this structure the support is internal of the insulation. At the manufacturing stage this internal support can be easily incorporated into the insulation.

Component 200 further includes a wire ridge support 208 which protects the edges from damage when using relatively crushable insulation types without need of a full collar as some lighter materials may require (as at 202 FIG. 20). Wire ridge support 208 is supported by vertical bars 209 internal of the insulation.

Component 200 further demonstrates that a wire mesh or grid 210 embedded just beneath the insulation surface may be used to support overlying components. The rigidity of the wire mesh 210 may vary with the relative crushability of the insulation. In certain site conditions where the components are handled many times, the insulating material may benefit from this kind of protection.

Component 200 further demonstrates a wrapping 212 put over the wire mesh 210 which prevents the wire and insulation from being damaged by sun or water in construction. Wrapping 212 prevents further damage from water and frost once the wall is established.

Component 200 further shows an illustrative moisture drainage path 192 which is isolated from the bonding material by putting a fine screen-like material 214 around the entire perimeter of the protruding portion of insulation. This serves as an alternative method to wrapping individually each moisture drainage path.

It should be noted that the illustrated insulation rigidification and support structures not only add to product strength (serving as alternative height stabilizing means) but also do not detract from the insulative value of the insulation.

FIG. 22 is a view substantially similar to FIG. 5 and including the one additional feature of face plates 210 and 211 which may be added to the outer or inner surface of the building components to present desired facial appearances. The face plates 210 may be held in place, as illustrated in FIG. 22, by a spring wire which preferably runs the length of face plate 210 and terminates in an enlarged portion residing within the canal 95. Like means may be used to support face plates 211. These plates allow the desired look to be installed into the component at the manufacturing plant on short notice prior to shipment. For example, if the component is made of wood chips, then a burnt clay face could be added, or any ceramic tile pattern. It will be appreciated that the face plates may be added at the construction site where the flowable bonding material may serve to anchor the spring wire in the inner horizontal canal.

FIGS. 23, 24, 25, 26, illustrate corner components constructed in accordance with the present invention.

Figure 23:
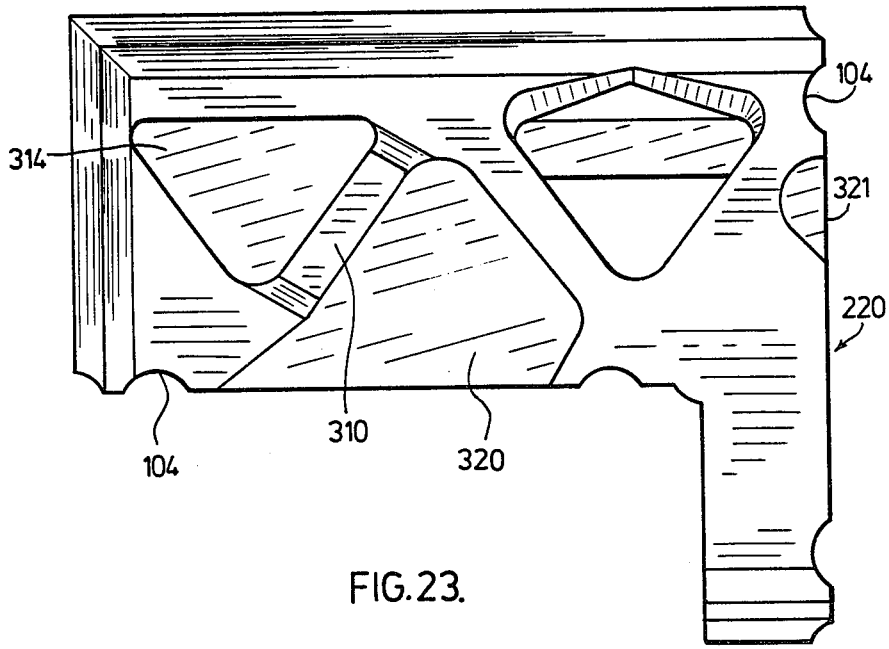
FIGS. 23, 24, 25 and 26 illustrate corner building components in accordance with the instant invention with the various designs corresponding to those used with different width measurements of the components of the invention.

FIG. 23 depicts a "return left" corner component 220 suitable for use with the 12 inch by 3 inch by 10 inch component 40 illustrated in FIGS. 1–11.

Figure 24:
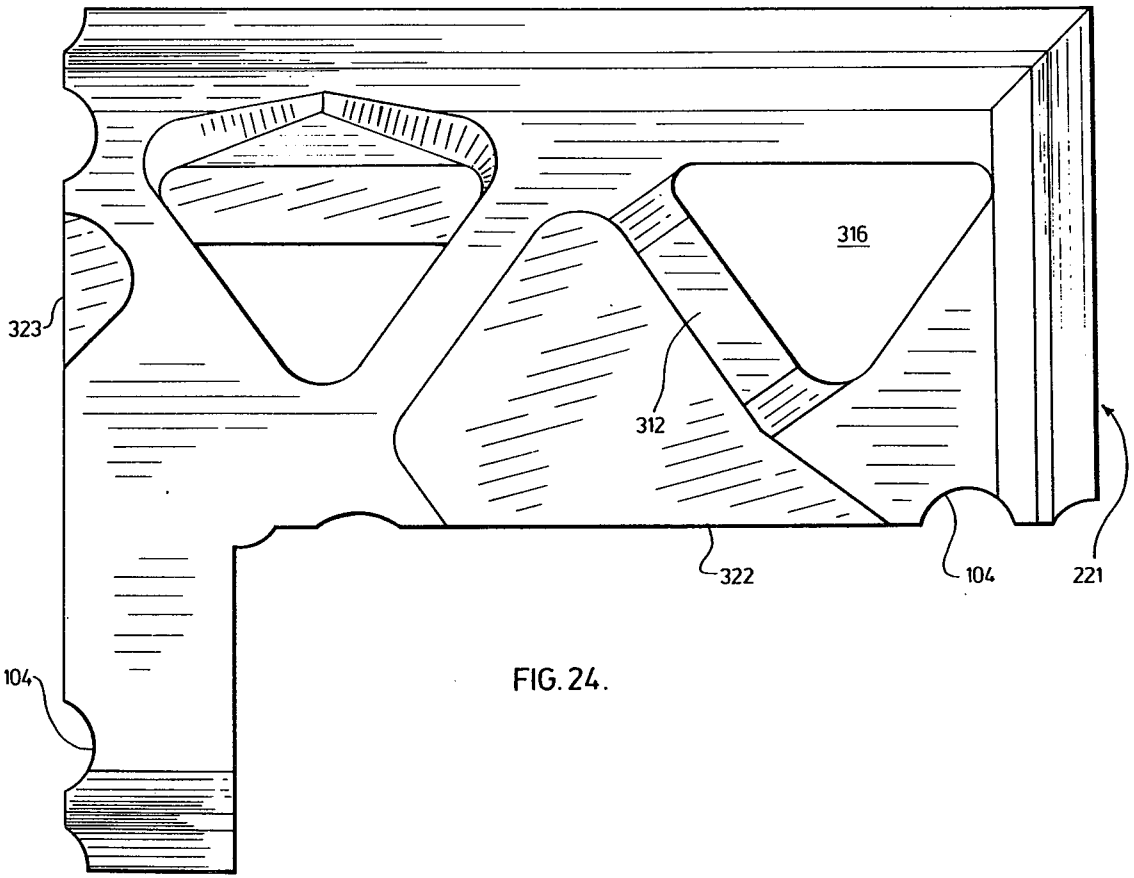

FIG. 24 is a "return right" corner component 221 for a 12 inch by 3 inch by 10 inch width component 40 which is adapted to exactly overlap at 90° over component 220 of FIG. 23. Component 221 is a mirror image of component 220. Components 220, 221 include height stabilizers 310, 312, respectively, which are adapted to overlie each other and provide support at the corner. Components 220, 221 also include enlarged vertical cores 314, 316 which overlie each other to form an enlarged vertical path at the corner for purposes of ease in filling with bonding material. The insulation 320, 321, 322, 323 in components 210, 211 are shaped to engage the insulation in the adjacent components 40 to maintain adequate insulation at the corner while not sacrificing strength.

Figure 25:
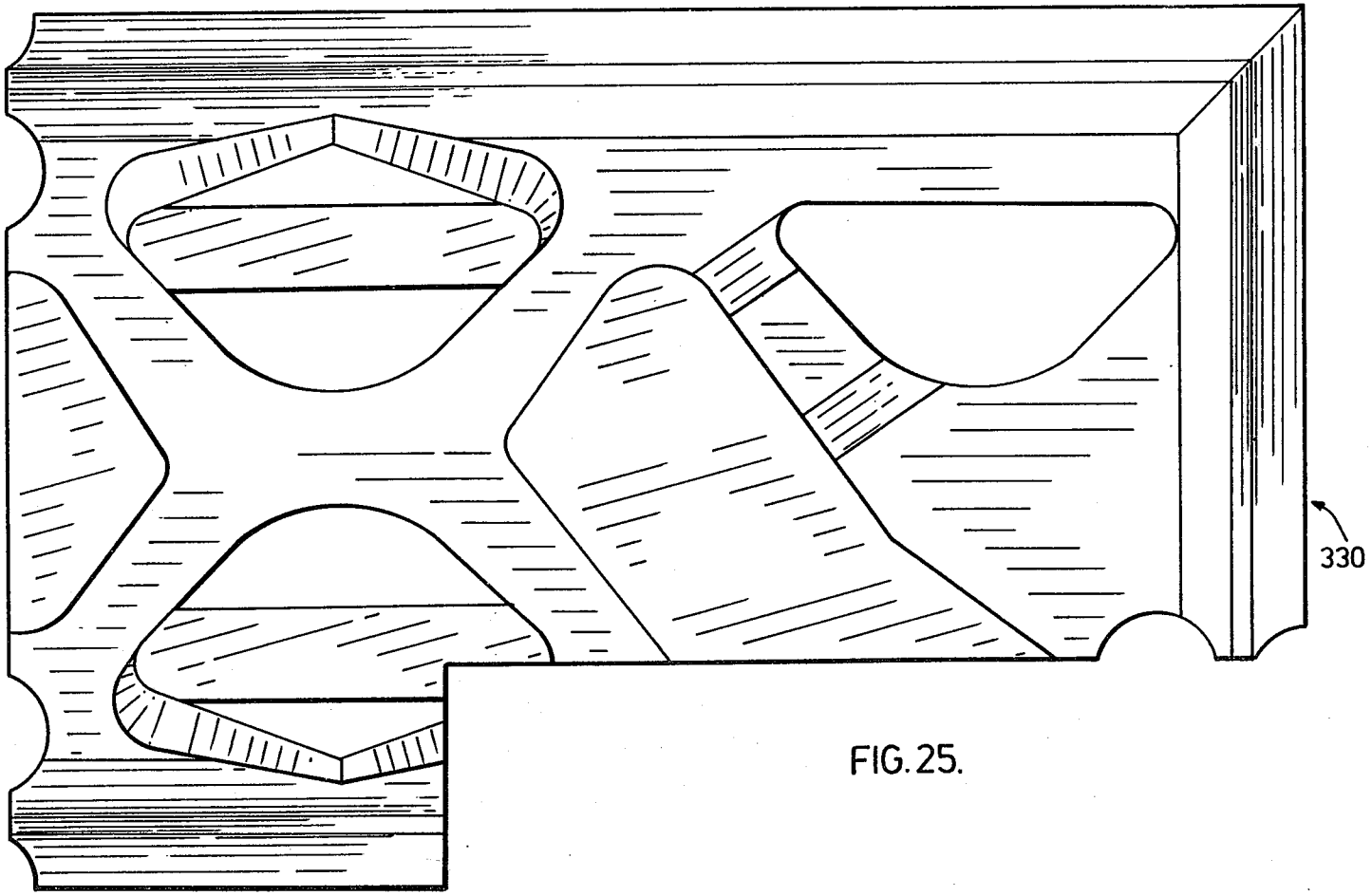

FIG. 25 depicts a corner component 330 similar in structure to component 221 but for use with narrower (8 inch) components.

Figure 26:
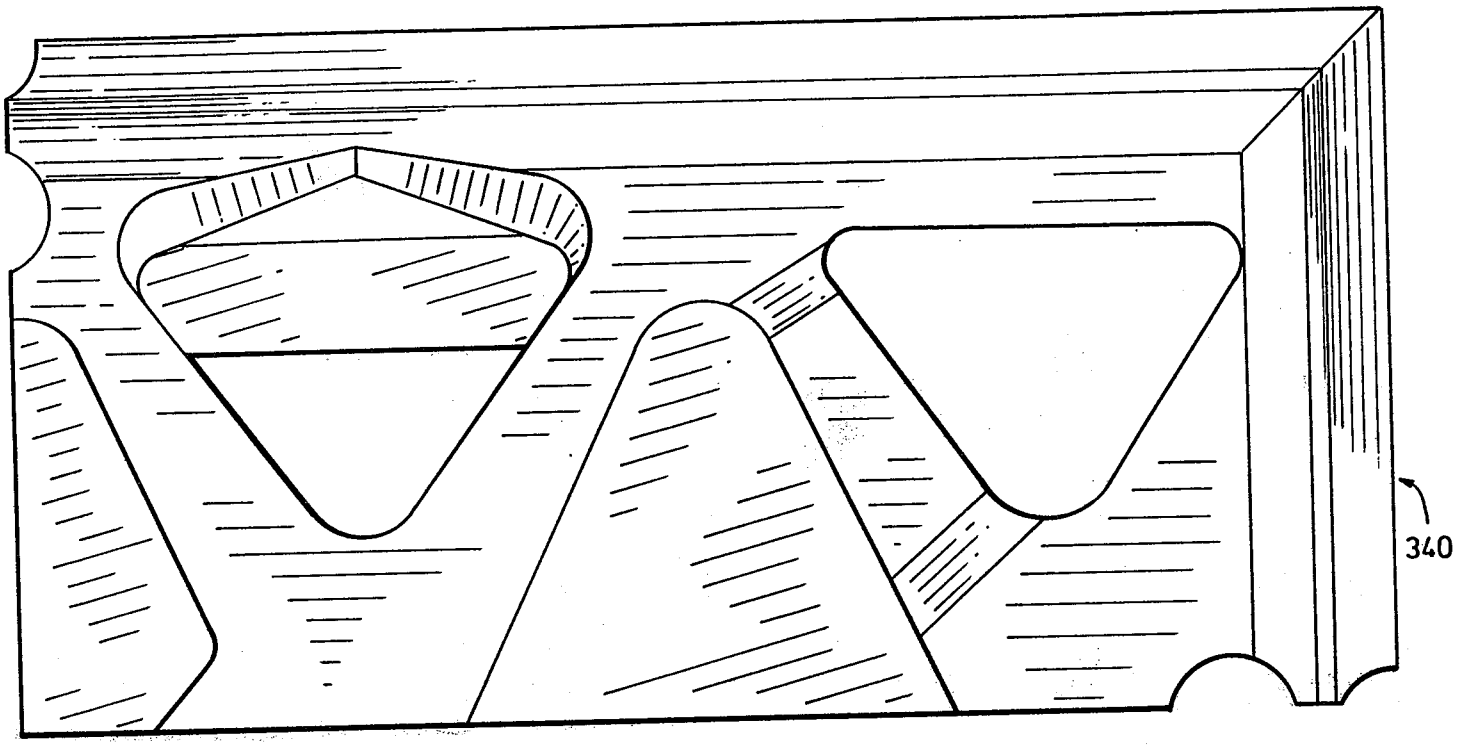

FIG. 26 depicts a corner component 340 for use with wider (12 inch) components.

FIGS. 27, 28, 29, 30 illustrate various alternative embodiments for the horizontal alignment-containment ridges.

Figure 27:
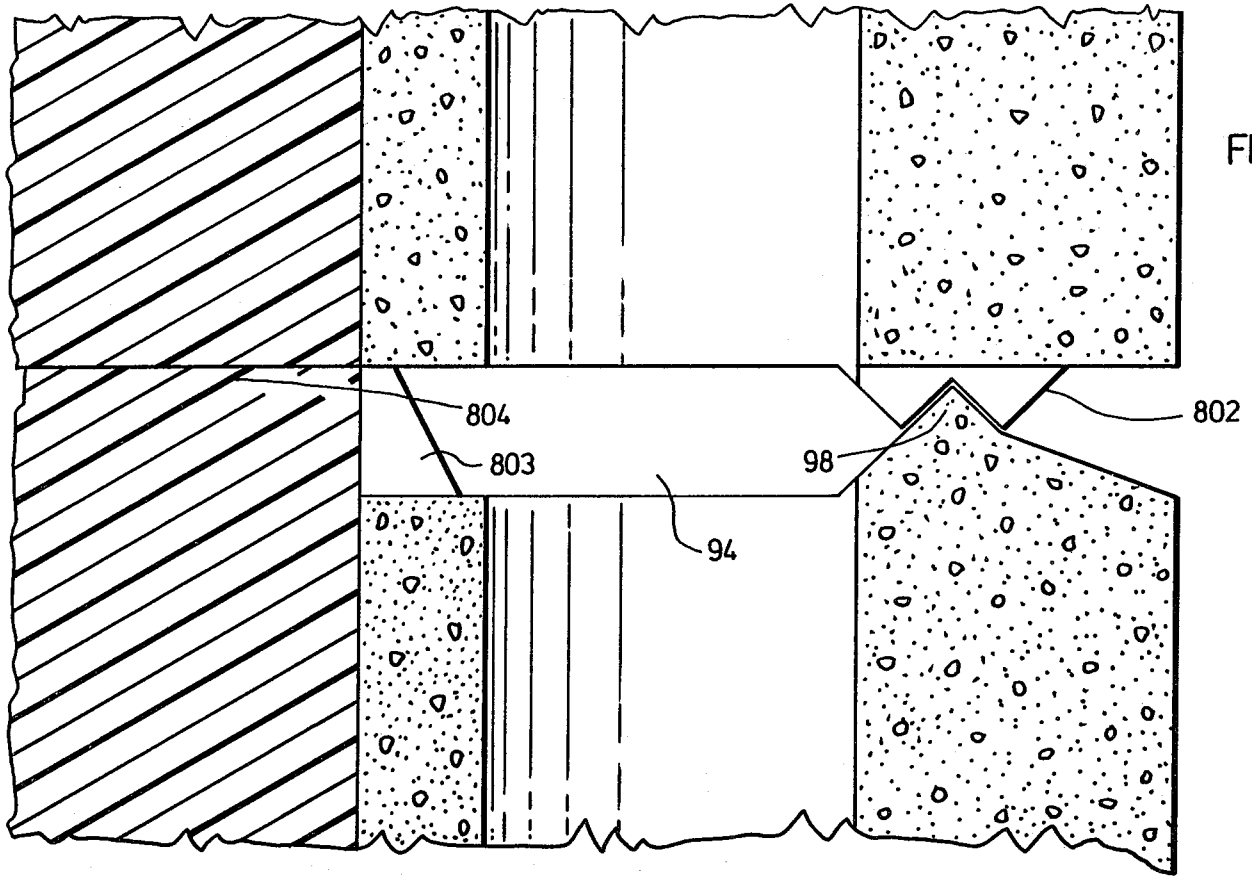
FIGS. 27, 28, 29 and 30 illustrate alternative configurations for the horizontal alignment-containment ridges.

FIG. 27 is the embodiment which is preferred when no mortar is used in the horizontal canal 94. Outer alignment-containment ridge 98 directly seats in the mid portion of a double alignment-containment ridge 802 formed in the bottom of the overlying component. Since there is no mortar to carry the load, ridges 98,802 share the load with the illustrated height stabilizer 803 and insulation 804. This type of double ridge ensures that no weather, dust or sand can work its way into the wall.

Figure 28:
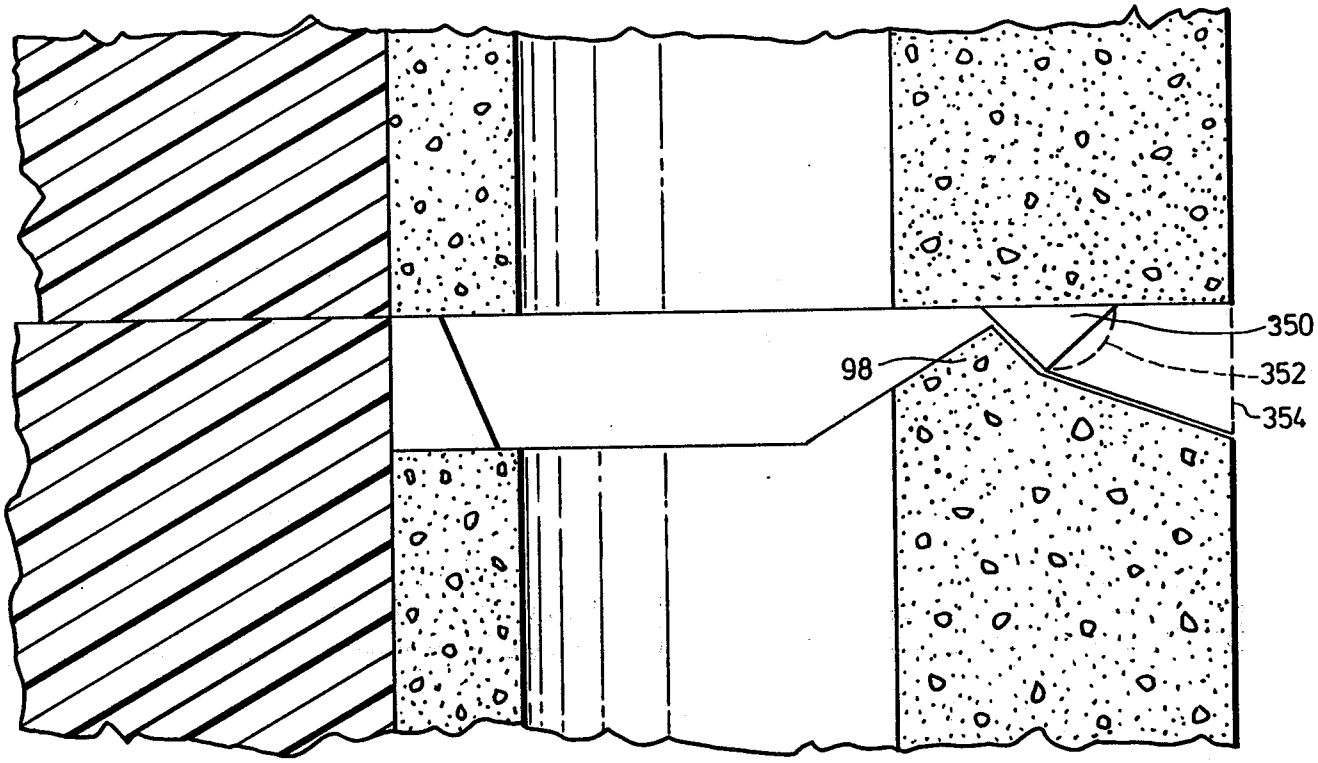

FIG. 28 shows a lower alignment-containment ridge 350 formed from a material different from the basic component and adhered to the component body by means of a suitable adhesive. This "added-on" ridge has as a primary purpose the provision of an accurately positioned ridge—more accurate than feasible when the ridge is formed by the mold from the basic component material. This is especially important for the embodiments of FIGS. 31-37 which are assembled from more parts and in more assembly stages than component 40 of FIGS. 1-11. Another reason for the add-on ridge is that the bottoms of the components can be formed first with flat pallets at the manufacturing stage. These pallets are common in use and therefore would save the manufacturer production costs.

A running bead 352 (shown in dashed lines in FIG. 28) in the form of a semicircular bulge may be used as an alternative add-on ridge. Bead 352 is preferably formed from a flexible material, e.g. tar, and has the advantage, due to its ability to deform, of providing a good seal.

Figure 29:
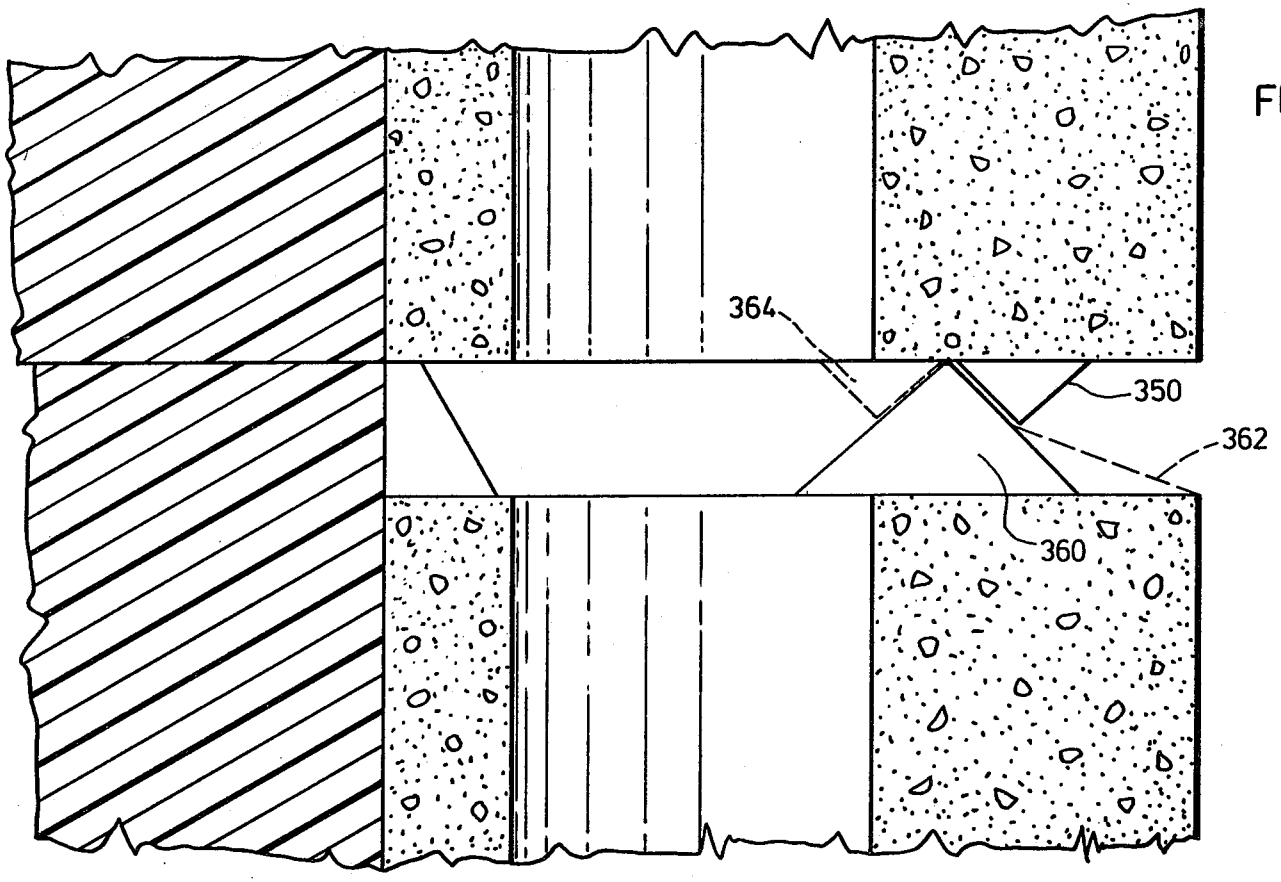

Reference numeral 354 denotes a very wide add-on ridge which, as with ridge 136 of FIG. 17, results in the outside surface being flush or coplanar with the outer surfaces of the adjacent building components. Ridge 354 may be desirable for use in underground basement or foundation uses to prevent the snagging at the interface between adjacent components. This is particularly useful (as in FIG. 17 mentioned) to prevent the abusive forces of frost, settlement, heaving, etc. Another advantage of ridge 354 is that it provides a more aesthetically pleasing appearance for the simulated mortar joint when used with protruding face plates, as 211 depicted in FIG. 22. FIG. 29 shows an add-on upper alignment-containment ridge 360 which may be adhered to its component in a similar fashion as ridge 350 of FIG. 28. FIG. 29 also depicts in dashed lines an enlarged ridge 362 which has the advantage, in cold climates, of preventing ice from lodging in the outer cavity defined by the engaged ridges. Also shown is an additional add-on ridge 364, which in conjunction with ridge 350, forms a double ridge having the advantages of ridge 802 of FIG. 27.

Figure 30:
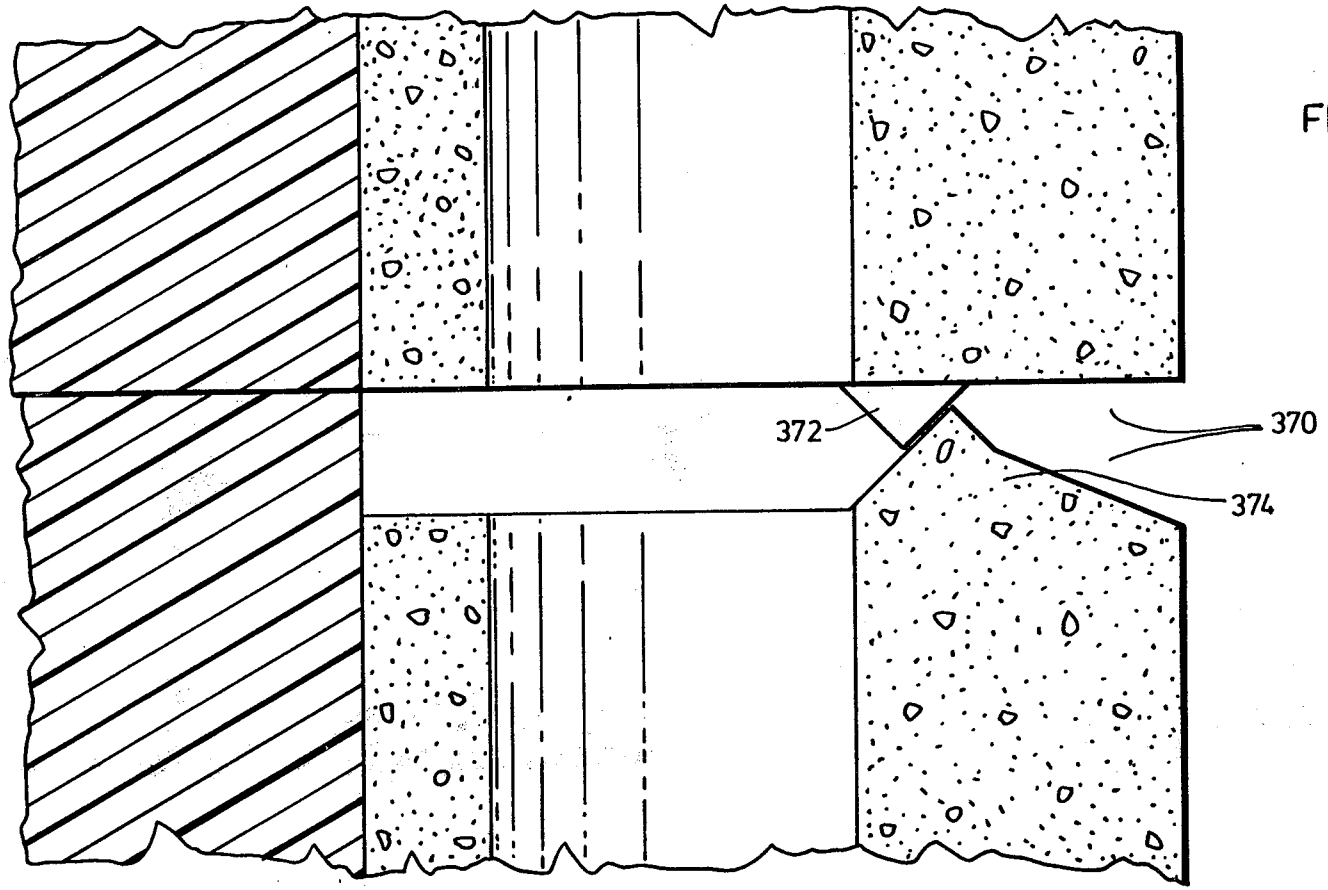

FIG. 30 illustrates a component for use when a deeper shadow accent is desired. The accent is created by horizontal crevice 370 defined by ridges 372, 374. This structure is particularly advantageous when the components are constructed in inverted fashion. This means that each component will selfalign if used upright or inverted.

Figure 31:
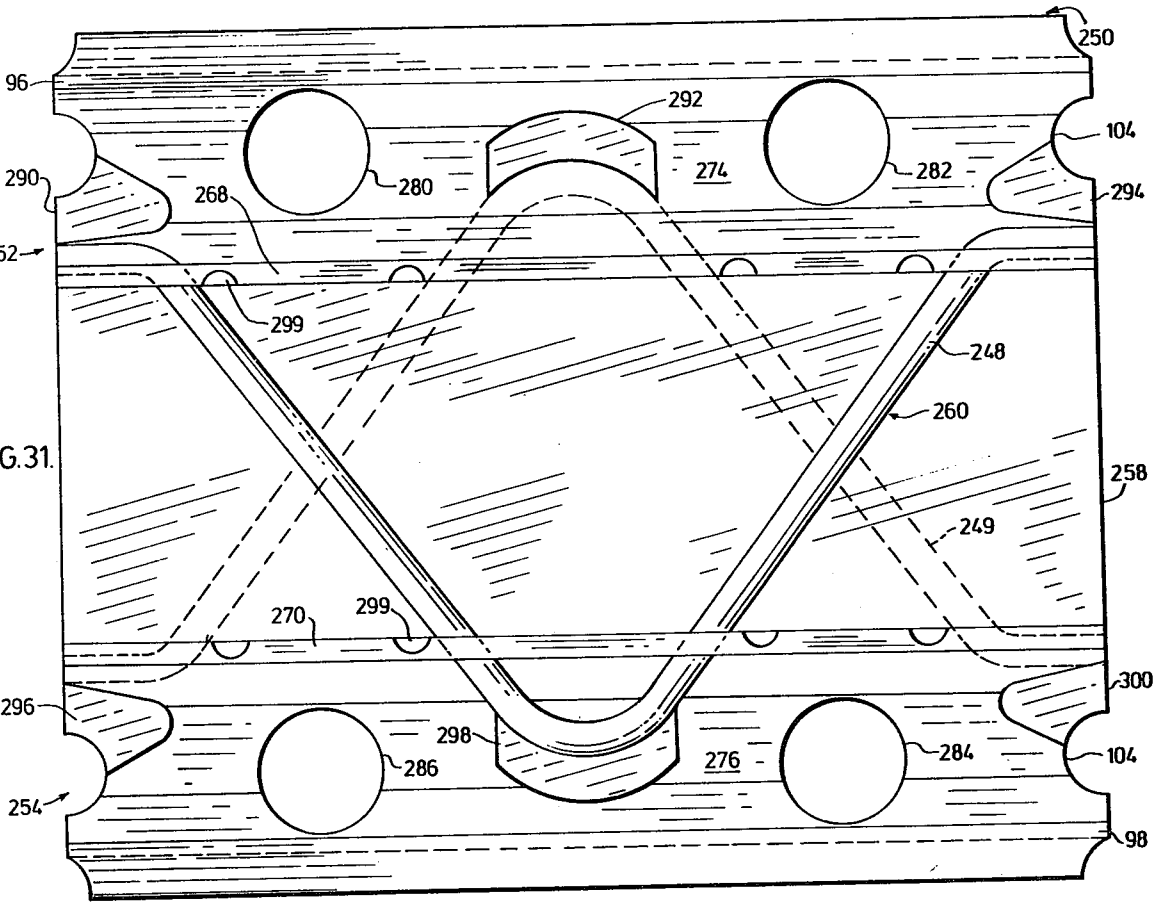
FIG. 31 is a top view of an alternative embodiment of the building component of the invention which includes steel bars embedded in the internal insulation material, forming a steel truss in place of one made of the component's basic material as in the other examples. The vertical cores align similar to FIG. 3 only the insulation is completely separated into the middle section of the component leaving maximum insulation content (i.e., a minimum "thermal bridge").
Figure 32:
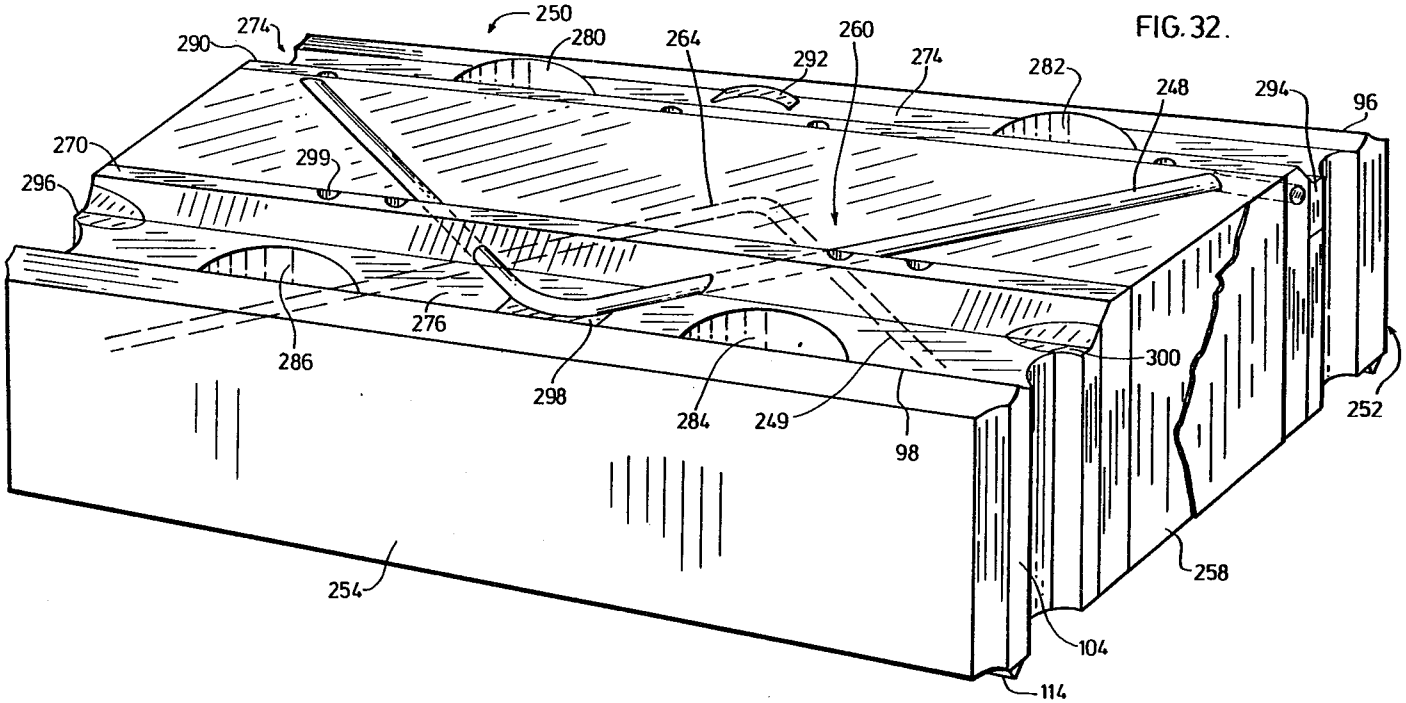
FIG. 32 is a pictorial view of the component illustrated in FIG. 31.

FIGS. 31 and 32 are top and top pictorial views, respectively, of another embodiment of a building component constructed in accordance with the present invention and designed to emphasize thermal insulative characteristics. Component 250 includes inside and outside component portions 252, 254 which are separated by insulating material 258 and are structurally interconnected by two steel bars 248, 249 having approximately 90° bends. Bars 248, 249 define cross members which overlap to form a two-cross truss 260. Bars 248, 249 are embedded below the surface of insulation 258 and are rigidly connected at their remote ends and mid portions to portions 252, 254. For ease of illustration in FIGS. 31 and 32 component 250 is shown with the insulation above bar 248 removed, with bar 249 shown in dashed lines.

Component 250 further includes longitudinal inner and outer height stabilizers 268, 270 which run the length of the component. Preferably, the level of insulation 258 is at the same height as the level of the raised inner and outer height stabilizers 268, 270.

The top surfaces of component portions 252, 254 are at a lower level than that of insulation 258 and height stabilizers 268, 270 and define longitudinal canals 274, 276 which are adapted to receive bonding material from nozzles inserted into vertical cores 280, 282, 284, 286 which are in fluid communication therewith.

Insulation pieces 290, 292, 294, 296, 298, 300 are optionally provided in inside and outside component portions 252, 254 at the points where the bars 248, 249 are attached in order to reduce the thermal conductance between the bars and the portions 252, 254. This eliminates the likelihood or cold spots and frost on the inner walls. Component 250 optionally includes moisture drainage paths 299.

While not illustrated, additional pairs of rigid bar crosses or trusses may be embedded in the insulation of building component 250, especially in situations where the component is made taller. It will be appreciated that bars 248, 249 serve to rigidly join the inside and outside component portions 252, 254 and operate in the fashion of the truss-shaped configurations described above in connection with other embodiments to lend rigidity and strength to the finished wall. As with component 40 described above, building components 250 are adapted to being overlayed in a 50% overlapping condition so that vertical cores 280, 286 are aligned vertically with cores 282, 284, respectively, in the underlying and overlying rows of components. Furthermore, in the 50% overlayed condition, the bar crosses will overlay each other to provide a vertically continuous truss structure at predetermined longitudinal intervals.

It will be understood that the space between the component portions 252, 254 defines the vertical opening which contains insulating material 258.

Furthermore, in a wall constructed utilizing building components 250 the overlying cores 280, 282, 284, 286 define the internal vertical paths which run the height of the wall and are filled with bonding material. In the wall, the canals 274, 276 define horizontally repetitive on-line continuous canal patterns formed within the wall at regular vertical intervals. Furthermore, in the wall, bars 248, 249 serve as rigid structural members and define a vertically aligned truss structure joining the interior and exterior surfaces of the wall.

Figure 33:
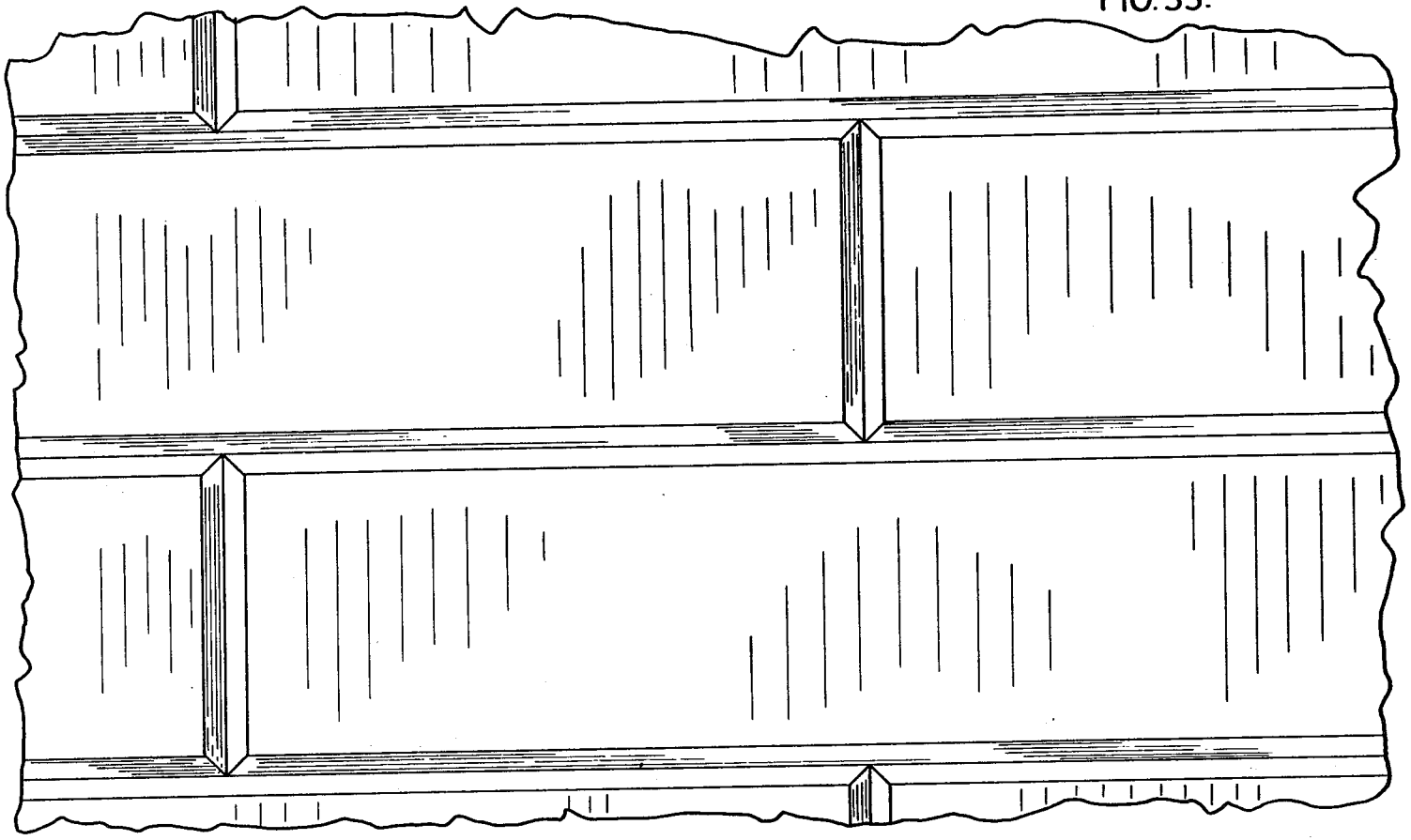
FIG. 33 is a view of a wall constructed in accordance with the invention showing the typical brick pattern.

FIG. 33 is a view of the outside face of a wall utilizing the 3" height by 12" long components.

Figure 34:
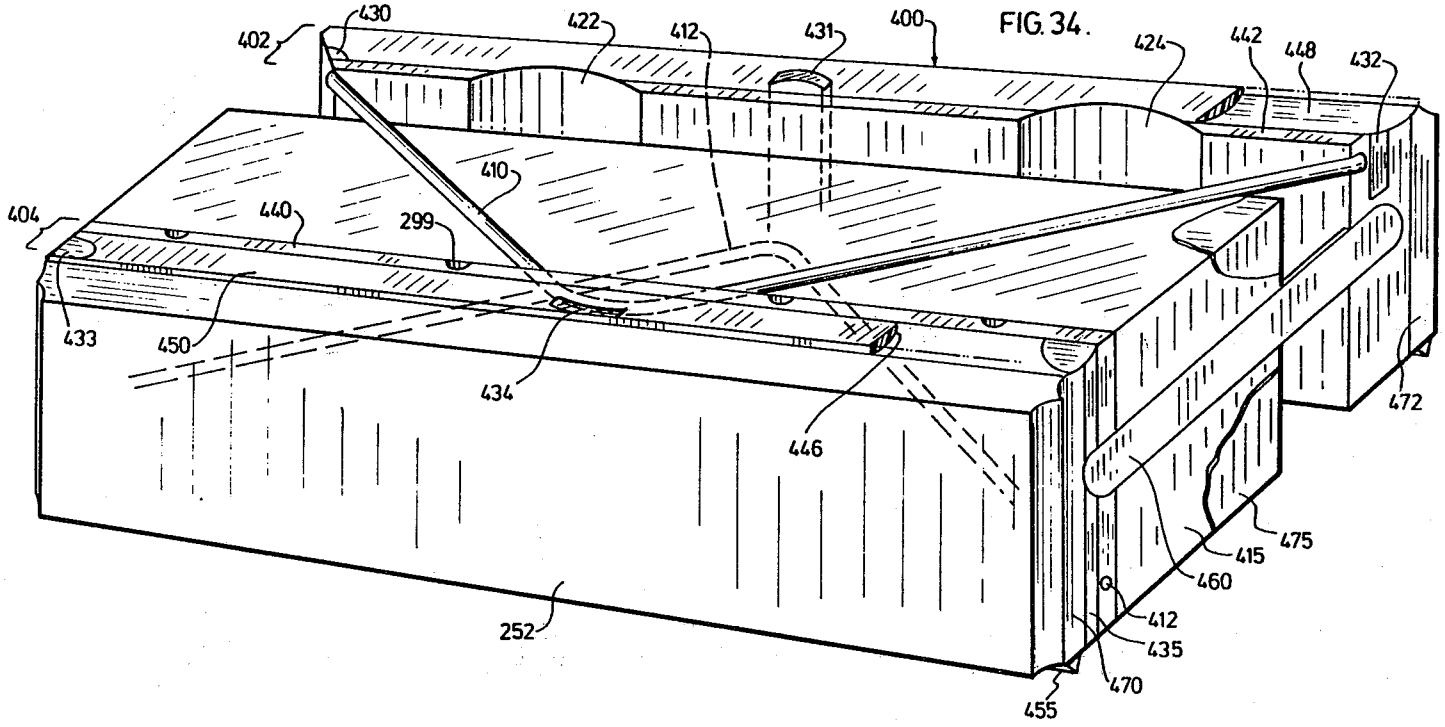
FIG. 34 is a top pictorial view showing another embodiment of the building component of the invention.
Figure 35:
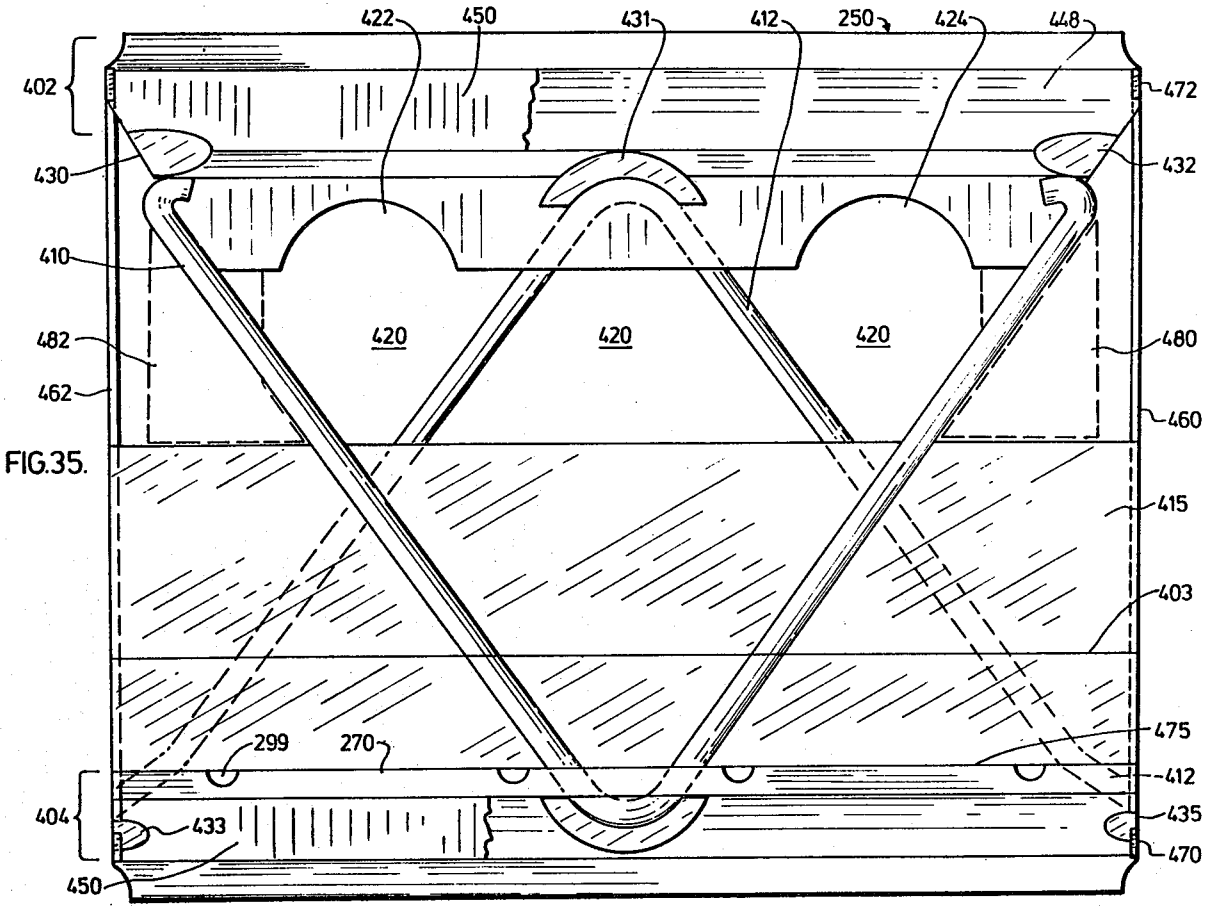
FIG. 35 is a top view of the component illustrated in FIG. 34.
Figure 36:
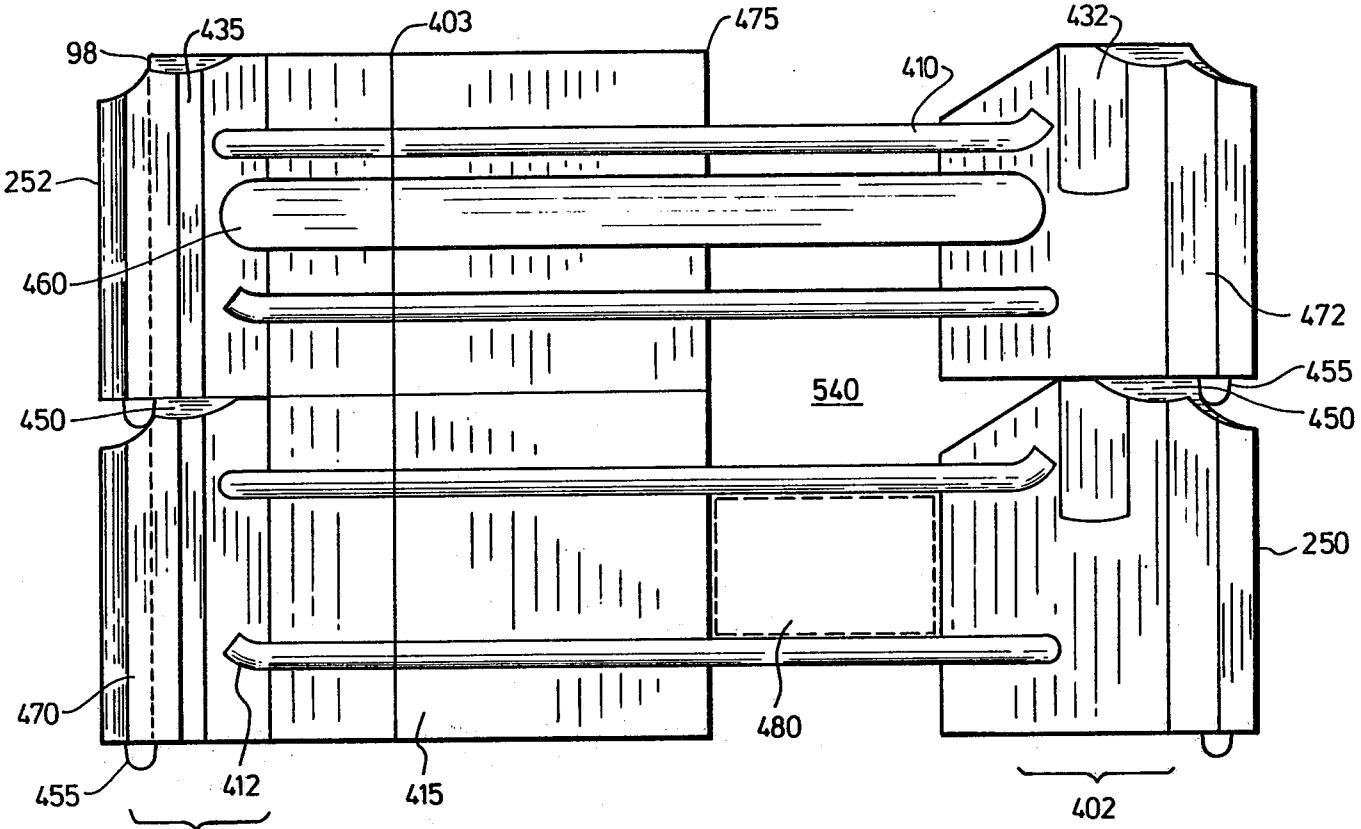
FIG. 36 is an end view of two stacked components of the type illustrated in FIGS. 34 and 35.

FIG. 34 is a pictorial view of another embodiment of the component of the invention also illustrated in a top view and an end view by FIGS. 35 and 36, respectively. This component emphasizes the "quick building" aspects of the invention. Component 400 comprises outer and inner component portions 402, 404, respectively, which are structurally interconnected by two steel truss bars 410, 412, substantially in the same manner as the inner connection of the portions of component 250 illustrated in FIGS. 31 and 32. The space between component portions 402, 404 is partially filled by insulating material 415 in which substantial portions of the bars are embedded. The volume holding the insulating material defines a "vertical opening" as that term is used herein. The remaining portion of the space separating component portions 402, 404 defines a single vertical core 420. Core 420 includes two recesses 422, 424, which are adapted to receive pump nozzles in the manner outlined above in connection with other embodiments of the invention or, in the alternative, receive poured-in bonding material. At the mid-portions and end portions of the bars 410, 412 where they are secured to the inner and outer components 402, 404 there may be provided optional insulation inserts 430, 431, 432, 433, 434, 435 which serve the purpose described above in connection with the description of component 250 of FIGS. 31 and 32. For ease of illustration in FIGS. 34 and 35, component 400 is shown with the insulation above bar 410 removed, with bar 412 shown in dashed lines.

Component 400 further includes longitudinal inner and outer height stabilizers 440, 442 which run the length of the component. Preferably the level of insulation 415 is at the same height as the level of the raised inner and outer height stabilizers 440, 442. The top surfaces of component portions 402, 404 are at a lower level than that of insulation 415 and height stabilizers 440, 442 and define longitudinal canals 446, 448 which are adapted to contain bonding material. In the illustrated embodiment, the bonding material 450 is a resilient sealant bonding material applied in canals 446, 448 during the manufacture of the building component. Bonding material 450 is adapted to sealingly engage the underside of overlying components in a wall to seal and bond the adjacent rows of components along their horizontal interfaces. The preapplied bonding material 450 may take the form of a tar-based sealant or "flexible waterproof membrane" manufactured by Uniroyal. It will be appreciated that canal 448 may be formed in fluid communication with core 420 so that canal 448 may be filled at the construction site with fluid bonding material pumped into core 420 in the manner described above in connection with other embodiments of the invention.

As shown in FIG. 36, component 400 includes a lower alignment ridge 455 which engages the top of underlying components to facilitate alignment of the components.

Component 400 also includes a pair of end bar stabilizers 460, 462, preferably in the form of flat metal bars, which are positioned in recesses in insulation 415 and secured to component portions 402, 404. Stabilizers 460, 462 lend addition structural support to component 400, and are particularly useful for preventing twisting of the component.

The ends of component 400 may optionally include resilient sealant bonding material, similar or identical to material 450, as at vertical surfaces 470 and 472. These surfaces are adapted to engage surfaces of abutting components in the same row of a wall to seal and bond the vertical interfaces between components in the wall.

Component 400 may include a moisture barrier 475 for covering the exposed surfaces of insulation 415 and the surfaces of the insulation contacting the body of the component.

Figure 37:
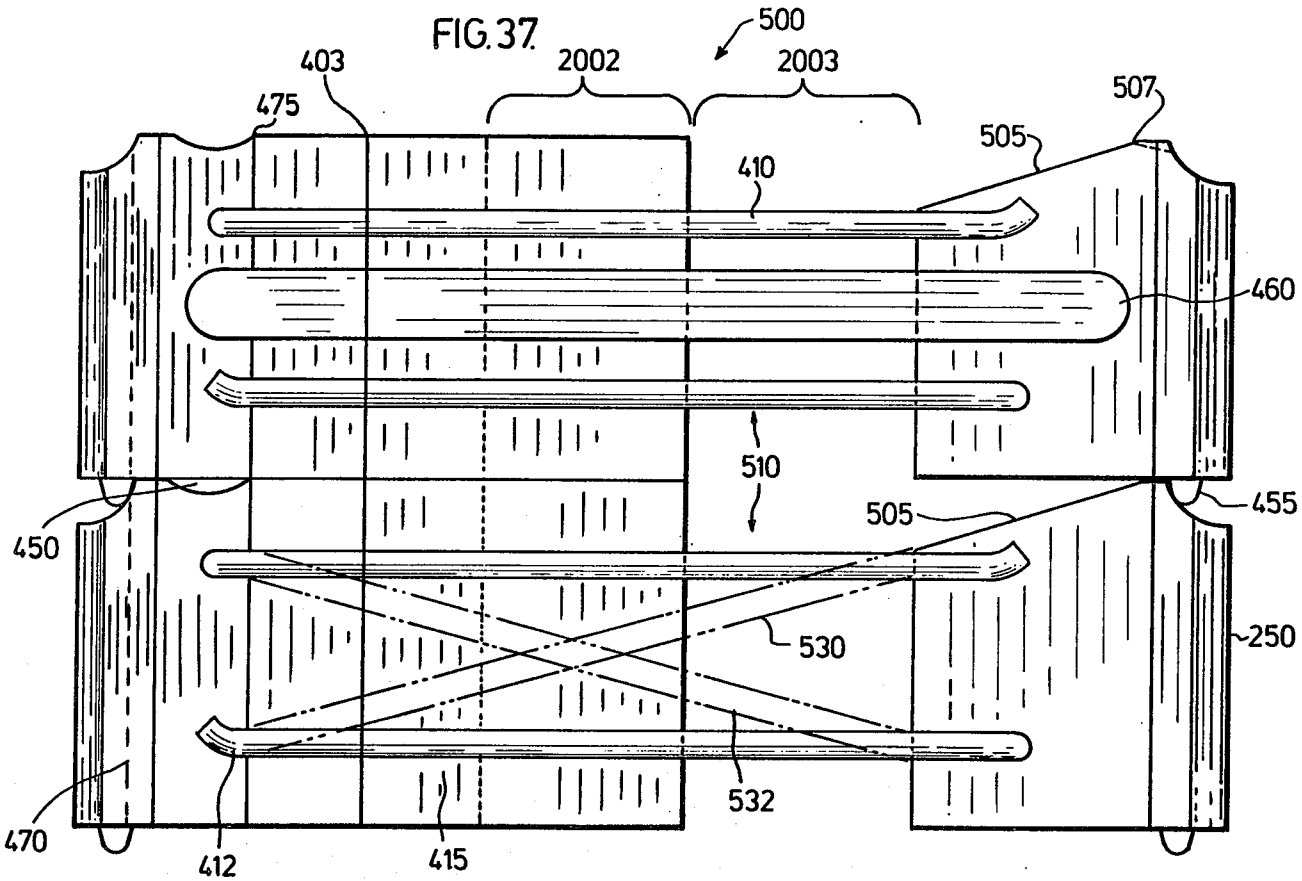
FIG. 37 is an end view of two stacked components similar to those illustrated in FIG. 36.

The outer and inner component portions 402, 404 may be made from different materials so that structurally and aesthetically desired wall faces may be provided for the inside and outside surfaces of the wall. The thicknesses of portions 402, 404 may be chosen to provide desired structural characteristics in view of the material being used and the end use of the component. To increase the load bearing capability of the wall inner component 404 may be made approximately equal in thickness to component 402 as shown by line 403 (FIGS. 35 and 36). Further, component 400 offers the advantage of a single large vertical core 420 which may be rapidly filled, for example, by pumping or pouring of fluid bonding material. As shown in FIG. 37, air relief grooves 507 enable the complete filling by venting excess air.

A further option for component 400, illustrated in dashed lines in FIG. 35, is a pair of stabilizer members 480, 482 formed as continuations of component portion 402 and secured to insulation 415. Members 480, 482 may be provided in place of or in addition to end bar stabilizers 460, 462 to lend additional structural support to the component.

FIG. 37 is an end view of a building component 500 similar to component 400 illustrated in FIGS. 34, 35 and 36. Component 500 differs from component 400 in that the canal in the outside wall has been eliminated and the outside wall has been tapered, as at 505, so that bonding material introduced into the vertical core 510 may fill the space between taper 505 and the overlying component. Component 500, because of the additional fluid bonding material, forms a stronger wall than component 400. Furthermore, the additional surface area along taper 505 and the underside of the overlying component results in a more complete bond between the components.

In use of component 500 it is preferable that the core 510 be filled soon after the wall is formed so that there is no chance for moisture to penetrate from the outside prior to filling. In distinction, component 400, having sealant and bonding material 450 along the outer wall, seals out moisture so that the pumping or pouring of fluid bonding material may occur up to several weeks after the wall is formed.

FIG. 37 also illustrates in dashed lines an alternative cross rod configuration comprising rods 530, 532 which may be substituted for or used in conjunction with the other bar patterns discussed above. The cross configuration of bars 530, 532 lends additional rigidity to the component, especially in preventing twist.

While the introduction of fluid bonding material into the cores of the components illustrated in FIGS. 34–37 may be most advantageously accomplished from the top, it will be appreciated that in certain circumstances, for example when access to the top of a wall is limited, the fluid bonding material may be introduced by pumping into the side of the aligned cores. Adequate clearance for the horizontal introduction of nozzles may be allowed for in the placement of the bar supports as shown, for example, by the space designated 540 in FIG. 36. Referring to FIG. 37, the insulation section 2002 may be located at 2003 for an alternate core configuration.

It will be appreciated that a wall constructed in accordance with the present invention may be constructed by first setting a straight mortar bed using an accurate, low tolerance, conventional form to make such bed level. The initial rows of building components are then stacked on this level bed, and secured utilizing conventional means such as keyed footings or rebar. The components may be assembled in the mentioned 50% overlying relationship or other desired relationship to provide a wall of completed height or, alternatively, a wall of a height at which the bonding material will be first introduced into the components, for example, by the pumping of mortar.

The term "bonding material" has been used in the specification to refer to that material, for example, mortar, which is used to join the assembled building components into a finished wall. The bonding material may be fluid material pumped or poured at the construction site, resilient bonding material applied during manufacture of the component, or other suitable material.

An illustrative method of manufacturing a building component of the instant invention, for example building component 40, will now be described. Component 40 may be manufactured on a hydraulic or cam actuated press and preferably made from a crystallized silicate aggregate such as concrete or clay. A woodchip and straw-plus-epoxy composition or plastics material or other available materials suitable for indoor or outdoor use may be used.

For ease in removing the product from its mold, any vertical cores and vertical canals may be provided with slight tapers toward the bottom of the component.

While the upper alignment-containment ridges of component 40 are preferably formed by the machine head, the bottom alignment-containment ridges may be formed by beads of a tar-derivative substance applied along the substantially planar bottom surface of the component as continuous longitudinal beads, or simply tacked on. Of course, the invention is not so limited.

Facial effects may be formed by various mold release methods or by facial texturizing or other treatments. Alternatively, face plates may be added.

In the case of the embodiments of FIGS. 31–37, the outer and inner component portions are first manufactured and then assembled with pre-made internal insulative pieces. The steel-rod trusses are assembled and affixed during this process.

As discussed in connection with the description of building component 40, the height stabilizers 80, 82, 84, 86 and/or vertical contact surfaces 106, 108 may be coated with a suitable material, for example rubber or plastics, and then run through a grinding machine to assure the desired height and length for the component. This is preferred in some applications but not always desirable.

The insulation is added to the vertical openings by any suitable technique, for example, by injecting foam setting materials into the openings while providing a containment at the top and bottom to form the correct height for the insulation. Also, inserts may be pre-made and simply inserted into the vertical openings. The inserts may contain the protective wraps and/or moisture drainage paths referred to above in connection with specific embodiments of the component.

While the above description has described a method of quickly and easily forming a load bearing, insulated wall utilizing a number of self-aligning, load bearing insulated building components in connection with specific embodiments and process steps, it will be apparent to those skilled in the art that many modifications and changes may be made without departing from the spirit and scope of the invention. It is the applicant's intention in the following claims to cover all such equivalent modifications and variations as fall within the true spirit and scope of the invention.

What is claimed is:

1. A building component comprising:

a body portion defining top and bottom surfaces, interior and exterior wall surfaces, and end surfaces adapted for abutting engagement in rows of a wall to formed with multiple building components;

at least one vertical opening formed in said body, said opening including insulating material which protrudes by a predetermined amount from at least one of said top and bottom surfaces of said body and is adapted to engage the opposing surface of the overlying or underlying components;

fluid bonding material containment ridges formed on the top and bottom surfaces;

fluid bonding material flow canals defined by said containment ridges and the borders of said protruding insulating;

at least one vertical core which, when multiple building components are assembled to form a wall in a designed overlapping manner, will align with vertical cores in underlying and overlying components to define a vertical path throughout the height of the wall;

said vertical path communicating with said canals and being adapted to receive fluid bonding material;

whereby fluid bonding material may be introduced into said vertical path into communication with said canals to fill said canals with a desired volume of bonding material at the interface between the adjoining rows of building components in a wall;

wherein said vertical opening and insulation material therein define a vertical air relief passageway open to the border of the protruding insulation adjacent one of the canals;

wherein said vertical opening, insulation material located therein, and the vertical passageway are adapted, respectively, to align with the vertical openings, insulation material, and vertical passageways in underlying and overlying components to form, respectively, vertical continuous vertical openings, insulation material, and vertical passageways; and screen means disposed between said one canal and the vertical passageway to substantially prevent flow of fluid bonding material into the vertical passageway from said one canal.

* * * * *